US010655446B2

(12) United States Patent
Ayub

(10) Patent No.: US 10,655,446 B2
(45) Date of Patent: May 19, 2020

(54) SYSTEMS, APPARATUSES, AND METHODS FOR DOWNHOLE WATER SEPARATION

(71) Applicant: Saudi Arabian Oil Company, Dhahran (SA)

(72) Inventor: Muhammad Ayub, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/041,489

(22) Filed: Jul. 20, 2018

(65) Prior Publication Data

US 2019/0032464 A1 Jan. 31, 2019

Related U.S. Application Data

(60) Provisional application No. 62/537,582, filed on Jul. 27, 2017.

(51) Int. Cl.

| | |
|---|---|
| ***E21B 43/38*** | (2006.01) |
| ***E21B 34/06*** | (2006.01) |
| ***E21B 33/12*** | (2006.01) |
| ***E21B 43/119*** | (2006.01) |
| ***E21B 43/12*** | (2006.01) |

(52) U.S. Cl.

CPC ..... *E21B 43/38* (2013.01); *E21B 33/12* (2013.01); *E21B 34/06* (2013.01); *E21B 43/119* (2013.01); *E21B 43/121* (2013.01); *E21B 43/385* (2013.01)

(58) Field of Classification Search

CPC ..... E21B 33/12; E21B 43/119; E21B 43/121; E21B 43/38; E21B 43/385; E21B 34/06

See application file for complete search history.

(56) References Cited

U.S. PATENT DOCUMENTS

| | | | | |
|---|---|---|---|---|
| 3,289,608 | A * | 12/1966 | Laval, Jr. | E21B 43/38 166/105.1 |
| 4,148,735 | A * | 4/1979 | Laval, Jr. | E21B 43/38 166/105.1 |
| 5,314,018 | A | 5/1994 | Cobb | |
| 6,283,214 | B1 | 9/2001 | Guinot et al. | |
| 6,805,806 | B2 * | 10/2004 | Arnaud | B01D 21/2433 210/788 |
| 8,844,614 | B2 | 9/2014 | Brown et al. | |
| 9,359,879 | B2 * | 6/2016 | Gill | E21B 43/38 |
| 2003/0085185 | A1 | 5/2003 | Kouba | |
| 2004/0206503 | A1 | 10/2004 | Bell et al. | |
| 2006/0118303 | A1 | 6/2006 | Schultz et al. | |

(Continued)

FOREIGN PATENT DOCUMENTS

| | | |
|---|---|---|
| CA | 2197377 | 8/1998 |
| GB | 2420804 | 6/2006 |

(Continued)

OTHER PUBLICATIONS

International Search Report and Written Opinion issued in International Application No. PCT/US2018/044070 dated Jan. 28, 2019, 17 pages.

PCT Communication (Invitation to Pay Additional Fees and, Where Applicable, Protest Fee PCT Article 17(3)a and Rule 40.1 and 40.2e) issued in International Application No. PCT/US2018/044070 dated Oct. 18, 2018, 13 pages.

(Continued)

*Primary Examiner* — Robert E Fuller
*Assistant Examiner* — Christopher J Sebesta
(74) *Attorney, Agent, or Firm* — Fish & Richardson P.C.

(57) ABSTRACT

This document relates to systems and techniques for downhole separation of water and oil in oil well operations.

13 Claims, 9 Drawing Sheets

(56) References Cited

U.S. PATENT DOCUMENTS

| | | | | |
|---|---|---|---|---|
| 2006/0231257 | A1 | 10/2006 | Reed et al. | |
| 2010/0000731 | A1 | 1/2010 | Gordon | |
| 2011/0048696 | A1 | 3/2011 | Holte | |
| 2013/0037264 | A1* | 2/2013 | Brown | E21B 43/119 166/265 |
| 2013/0180714 | A1* | 7/2013 | Nevin | E21B 37/00 166/280.1 |
| 2014/0158352 | A1* | 6/2014 | Ramsey | E21B 43/385 166/265 |
| 2014/0174734 | A1 | 6/2014 | Gill | |
| 2014/0216720 | A1 | 8/2014 | Wang et al. | |
| 2016/0265521 | A1* | 9/2016 | Butler | E21B 43/128 |
| 2017/0328189 | A1* | 11/2017 | Wang | E21B 43/38 |
| 2018/0156021 | A1 | 6/2018 | Ayub et al. | |

FOREIGN PATENT DOCUMENTS

| | | |
|---|---|---|
| WO | 01/65065 | 9/2001 |
| WO | 2004023053 | 3/2004 |
| WO | 2009006672 | 1/2009 |
| WO | 2013022551 | 2/2013 |

OTHER PUBLICATIONS

"Downhole Oil Water Separation (DOWS)", Theme Initiation Report, ITF Theme, Jul. 11, 2015, 31 pages.

Bowers et al., "Development of a Downhole Oil/Water Separation and Reinjection System for Offshore Applications," SPE 63014-PA, SPE Production & Facilities, vol. 15 (2), May 2000, 8 pages.

Lakos, "Down Hole Separators (DHS)", LAKOS Separators and Filtration Solution, www.lakos.com, Dec. 2012, 4 pages.

Ogunsina, "A Review of Downhole Separation Technology," SPE 94276, paper presented at the 2005 SPE Production and Operations Symposium, Apr. 17-19, 2005, 8 pages.

Peachy and Matthews, "Downhole Oil/Water Separator Development," JCPT94-07-01, Journal of Canadian Petroleum Technology, vol. 33, No. 7, Sep. 1994, 6 pages.

Veil et al., "Feasibility Evaluation of Downhole Oil/Water Separation (DOWS) Technology," Technical Report for U.S. Department of Energy, Jan. 1999, 66 pages.

International Search Report and Written Opinion issued in International Application No. PCT/US2018/043672 dated Nov. 20, 2018, 14 pages.

GCC Examination Report in GCC Appln. No. GC 2018-35722, dated Dec. 26, 2019, 5 pages.

* cited by examiner

SYSTEMS, APPARATUSES, AND METHODS FOR DOWNHOLE WATER SEPARATION

CROSS-REFERENCE TO RELATED APPLICATION

This application claims the benefit of priority to U.S. Provisional Application Ser. No. 62/537,582 filed on Jul. 27, 2017, the contents of which are hereby incorporated by reference.

TECHNICAL FIELD

This document relates to systems and techniques for downhole separation of water and oil in oil well operations.

BACKGROUND

Waste water production with oil and gas is a challenge for the oil and natural gas industry. During the production of oil and natural gas, the oil and natural gas sometimes also includes water (for example, water-cut). The water produced through wells can originate from the hydrocarbon bearing zones, from aquifers that are near the hydrocarbon bearing zones, or from water that is injected downhole. Water may be injected downhole to improve reservoir sweep efficiency for pressure maintenance. Various chemicals are sometimes also mixed with the injection water to improve the reservoir sweep efficiency. When produced at the surface, this mixture of water, oil and gas can create a concern from an environmental stand point. In wells that are drilled into mature reservoirs the water-cut can increase, reducing the economic viability of the well and thus sometimes resulting in abandonment of wells.

In previous solutions, hydrocarbons and water are produced and separated at the surface. Previous solutions also include blocking the water encroachment by mechanical means, chemicals, controlled production, or some combination of these approaches. Such solutions often adversely compromise the oil production capacity of wells.

SUMMARY

In general, this document describes systems and techniques for downhole separation of water and oil in oil well operations.

An aspect relates to an oil well system for oil production and downhole water separation including a wellbore formed through an Earth surface into a hydrocarbon formation below the Earth surface. The wellbore includes a casing defining a tubular cavity. The wellbore includes cement in an annulus between the casing and the hydrocarbon formation. The wellbore also includes perforations through the casing and the cement into the hydrocarbon formation to receive an emulsion of liquid hydrocarbon and water from the hydrocarbon formation into the tubular cavity. The perforations are tangential to the casing to urge the emulsion into a rotational vortex in the tubular cavity to separate the liquid hydrocarbon from the water. The perforations may be tangential to an inner surface of the casing and in a cooperative orientation. A curvature of the inner surface may direct flow of the emulsion into a rotational flow about a central axis of the tubular cavity. The casing may be a cylindrical wall defining the tubular cavity and having the inner surface. The tubular cavity is in fluid communication with the hydrocarbon formation via the perforations. In examples, the perforations do not include radial perforations. The rotational flow and rotational vortex may involve hydrocyclonic flow.

The oil well system may include extraction tubing to convey the separated liquid hydrocarbon from the wellbore to the Earth surface, wherein the liquid hydrocarbon may include oil. Further, the wellbore includes a chamber at a lower portion of the wellbore to accumulate the water separated from the liquid hydrocarbon. In addition, the oil well system may include a propeller disposed in the chamber to agitate water in the chamber, such as to cause debris in the chamber to become suspended in the water in the chamber. A surface pump may pull water from the chamber through water outlet tubing to the Earth surface. A conduit in the wellbore may convey water from the Earth surface to the propeller to drive the propeller, wherein the propeller is a hydraulic propeller.

Another aspect relates to a method of operating an oil well system including downhole water separation. The method includes receiving through perforations into a wellbore an emulsion of liquid hydrocarbon and water from a hydrocarbon formation. The perforations are through a casing of the wellbore and tangential to an inner surface of the casing urging the emulsion into a rotational vortex to separate the water from the liquid hydrocarbon in the casing. The method includes collecting the separated water in a chamber at a lower portion of the wellbore and conveying the separated water to a surface end of the wellbore. The collecting of the separated water in the lower portion of the wellbore may involve receiving the separated water through a one-way valve at a packer in the wellbore to the lower portion of the wellbore. The packer and the inner wall of the casing at the lower portion of the wellbore may at least partially define a chamber that is the lower portion of the wellbore. The method may further include agitating water in the lower portion of the wellbore via a propeller in the lower portion of the wellbore. The example method may also include treating the separated water conveyed to the surface end of the wellbore to remove solids from the separated water.

Yet another aspect relates to an oil well system for oil production and downhole water separation, including a wellbore in a geological formation having an emulsion of liquid water and liquid hydrocarbon. The wellbore has perforations to receive the emulsion from the geological formation. The oil well system includes a water separator (for example, hydrocyclone) disposed in the wellbore to receive the emulsion and separate the liquid water from the liquid hydrocarbon. The water separator comprises multiple apertures to receive the emulsion into the water separator. The multiple apertures (for example, tangential slots) may be arranged to cooperate to provide for tangential entry of the emulsion into the water separator. Moreover, the oil well system may include a conduit, such as tubing, to transport the liquid hydrocarbon as separated to an Earth surface from the water separator.

Further, the oil well system includes a one-way valve at a packer in the wellbore to discharge the liquid water as separated to a bottom portion of the wellbore below the packer. The oil well system also includes a propeller in the bottom portion of the wellbore to agitate water in the bottom portion to suspend solids in the bottom portion into the water. A surface pump and a conduit, such as tubing, may provide water to the propeller to drive the propeller, wherein the propeller is a hydraulic propeller. The system may also include a surface pump to pump water having suspended solids from the bottom portion through a conduit to an Earth surface. A water treatment unit may be configured to receive the water having suspended solids and to remove solids from the water. Another wellbore may receive the water as treated from the water treatment unit for injection into the geological formation.

Yet another aspect includes a method of operating an oil well system for oil production and downhole water separation, including receiving an emulsion from a geological formation through wellbore perforations into a water separator (for example, hydrocyclone) in a wellbore, the emulsion having liquid water and liquid hydrocarbon. Receiving the emulsion into the water separator may include receiving the emulsion through multiple apertures (for example, tangential slots) of the water separator. The multiple apertures may cooperate providing for tangential entry of the emulsion into the water separator.

The method includes separating, via the water separator, the liquid water from the liquid hydrocarbon. The method includes discharging the liquid water from the water separator downward toward a one-way valve at a wellbore packer, and allowing the liquid water to flow through the one-way valve to a bottom portion of the wellbore below the wellbore packer. In addition, the method includes agitating, via a propeller, water in the bottom portion to suspend solids in the bottom portion in the water. In some examples, the method includes injecting water from an Earth surface to the propeller to drive the propeller, wherein the propeller is a hydraulic propeller.

The method may include pumping, via a surface pump, the water having suspended solids from the bottom portion of the wellbore through a conduit to an Earth surface. Furthermore, the method may include removing, via a water treatment unit, solids from the water having the suspended solids. Further, the method may include pumping the water from the water treatment unit to another wellbore and injecting the water into the geological formation via perforations in the another wellbore.

In a first aspect, a system for downhole water separation includes a wellbore comprising a tubular wall defining: (1) an inner surface of a wellbore within an oil reservoir formation within the Earth's crust; and (2) a first channel extending radially though the tubular wall and the inner surface, and defining a first longitudinal channel axis that is parallel or substantially parallel to a first tangent line that passes through a first point on the inner surface.

In some embodiments, the tubular wall can further define a first radius extending radially from a central axis defined by the tubular wall to the first point, and the first longitudinal channel axis and the first radius form a first angle that is within a first range of about 45° to about 135° or a second range of about 225° to about 315°.

In some embodiments, the system further includes a second channel extending radially though the tubular wall and the inner surface, and defines a second longitudinal channel axis that is parallel or substantially parallel to a second tangent line that passes through a second point spaced apart from the first point on the inner surface, wherein the tubular wall further defines a second radius extending radially from the longitudinal wall axis (or central axis) to the second point, and the second longitudinal channel axis and the second radius form a second angle that is within the same one of the first range or the second range as the first angle. In some embodiments, the tubular wall comprises a casing and a cement layer arranged radially about the casing in contact with the oil reservoir formation, wherein the first channel extends through the casing and the cement layer. In some embodiments, the first channel can extend into and is partly defined by a perforation formed in the oil reservoir formation along or substantially along the first longitudinal channel axis. In some embodiments, the system can further include a water separation apparatus disposed within the wellbore proximal to the first channel. The water separation apparatus can include a tubular housing and an extractor tube arranged within the tubular housing, and be configured to create a hydrocyclonic flow within the tubular housing.

In a second aspect, a method for forming a downhole water separator can include: (1) positioning a downhole tool in a wellbore formed in an oil reservoir formation, wherein the wellbore is defined by a tubular wall defining a central axis and an inner surface; and (2) perforating the tubular wall to define a first channel extending radially though the tubular wall and the inner surface, the first channel defining a first longitudinal channel axis that is parallel or substantially parallel to a first tangent line that passes through a first point on the inner surface.

In some embodiments, the tubular wall further defines a first radius extending radially from a central axis defined by the tubular wall to the first point, and the first longitudinal channel axis and the first radius form a first angle that is within a first range of about 45° to about 135° or a second range of about 225° to about 315°. In some embodiments, the wellbore further including a second channel extending radially though the tubular wall and the inner surface, and defining a second longitudinal channel axis that is parallel or substantially parallel to a second tangent line that passes through a second point spaced apart from the first point on the inner surface, wherein the tubular wall further defines a second radius extending radially from the central axis to the second point, and the second longitudinal channel axis and the second radius form a second angle that is within the same one of the first range or the second range as the first angle. In some embodiments, the tubular wall includes a casing and a cement layer arranged radially about the casing in contact with the oil reservoir formation, wherein the first channel extends through the casing and the cement layer. In some embodiments, the first channel extends into and is partly defined by a perforation formed in the oil reservoir formation along or substantially along the first longitudinal channel axis.

In a third aspect, a method for downhole water separation includes: (1) receiving, through a first channel defining a first longitudinal channel axis that is parallel or substantially parallel to a first tangent line that passes through a first point on an inner surface of a wellbore formed in an oil reservoir formation and extending radially though a tubular wall and the inner surface of the wellbore, a fluid mixture that comprises liquid water and liquid hydrocarbon moving in a linear flow or substantially linear flow along the first longitudinal channel axis from the oil reservoir formation to the wellbore; (2) contacting the inner surface with the fluid mixture; (3) redirecting, by the inner surface, the flow away from the first longitudinal axis and into a hydrocyclonic flow about the inner surface; (4) separating, by the hydrocyclonic flow, the liquid water from the liquid hydrocarbon; (5) drawing the separated liquid hydrocarbon into a tube disposed within the tubular wall proximal to the central axis; and (6) pumping the separated liquid hydrocarbon through the tube to a surface end of the wellbore.

In some embodiments, the separating, by the hydrocyclonic flow, the liquid water from the liquid hydrocarbon comprises: (1) flowing the fluid mixture in a rotational flow, wherein the liquid hydrocarbon has a buoyancy that is relatively different than that of the liquid water; (2) imparting, by the rotation flow, and acceleration upon the fluid mixture; (3) urging, by the acceleration, the liquid water radially away from the central axis and toward the inner surface; and (4) urging, by the buoyancy and the acceleration, the liquid hydrocarbon radially away from the inner surface and toward the central axis. In some embodiments, the tubular wall further defines a first radius extending radially from a central axis defined by the tubular wall to the first point, and the first longitudinal channel axis and the first radius form a first angle that is within a first range of about 45° to about 135° or a second range of about 225° to about 315°. In some embodiments, the wellbore further comprising a second channel extending radially though the tubular wall and the inner surface, and defining a second longitudinal channel axis that is parallel or substantially parallel to a second tangent line that passes through a second point spaced apart from the first point on the inner surface, wherein the tubular wall further defines a second radius extending radially from the central axis to the second point, and the second longitudinal channel axis and the second radius form a second angle that is within the same one of the first range or the second range as the first angle. In some embodiments, the tubular wall comprises a casing and a cement layer arranged radially about the casing in contact with the oil reservoir formation, wherein the first channel extends through the casing and the cement layer. In some embodiments, the first channel extends into and is partly defined by a perforation formed in the oil reservoir formation along or substantially along the first longitudinal channel axis.

In some embodiments, the method includes positioning a water separation apparatus within the wellbore proximal to the first channel, wherein the water separation apparatus comprises: (1) a tubular housing extending from an enclosed first longitudinal housing end to an enclosed second longitudinal housing end along a central axis and defining a housing inner surface of a tubular cavity; (2) an extractor tube arranged within the tubular housing and extending through the first longitudinal housing end, from a first open end proximal the first longitudinal housing end to a second open end within the tubular cavity; and (3) at least one aperture defined radially though the tubular housing and the housing inner surface, defined longitudinally at a location between the first longitudinal housing end and the second open end, and formed to create a second hydrocyclonic flow about the tubular cavity when a liquid flows into the tubular cavity through the aperture. The separating the liquid water from the liquid hydrocarbon can further include: (a) drawing a flow of the fluid mixture through the aperture; (b) contacting the housing inner surface with the fluid mixture; (c) redirecting, by the housing inner surface, the flow into the second hydrocyclonic flow about the housing inner surface; and (d) separating, by the second hydrocyclonic flow, the liquid water from the liquid hydrocarbon; wherein drawing the separated liquid hydrocarbon into a tube disposed within the tubular wall proximal to the central axis further comprises drawing the separated liquid hydrocarbon into; the extractor tube and wherein pumping the separated liquid hydrocarbon through the tube to a surface end of the wellbore further comprises pumping the separated liquid hydrocarbon though the extractor tube to the surface.

In a fourth aspect, a water separation apparatus includes: (1) a tubular housing extending from an enclosed first longitudinal housing end to an enclosed second longitudinal housing end along a central axis and defining an inner surface of a tubular cavity; (2) an extractor tube arranged within the tubular housing and extending through the first longitudinal housing end, from a first open end proximal the first longitudinal housing end to a second open end within the tubular cavity; and (3) at least one aperture defined radially though the tubular housing and the inner surface, defined longitudinally at a location between the first longitudinal housing end and the second open end, and formed to create a hydrocyclonic flow about the tubular cavity when a liquid flows into the tubular cavity through the aperture.

In some embodiments, the aperture can be formed as a tangential slot extending radially though the tubular housing and the inner surface, and defining a longitudinal channel axis that is parallel or substantially parallel to a tangent line that passes through a point on the inner surface. In some embodiments, the aperture is formed as a helical slot through the tubular housing and the inner surface. In some embodiments, the first open end is configured for connection to a pump configured to draw liquid hydrocarbons into the second open end and through the extractor tube. In some embodiments, the second longitudinal housing end is enclosed by a valve. In some embodiments, the valve is a flapper valve configured to enclose the second longitudinal housing end when fluid pressure within the tubular cavity is less than fluid pressure outside the tubular housing, and open the second longitudinal housing end when fluid pressure within the tubular cavity is equal to or greater than fluid pressure outside the tubular housing.

In a fifth aspect, a system for downhole water separation includes: (1) a wellbore in a geological formation having an emulsion of liquid water and liquid hydrocarbon; (2) a separator apparatus positioned within the wellbore; and (3) a pump hydraulically connected to the separator and configured to draw liquid hydrocarbon though the extractor tube. The separator apparatus includes: (i) a tubular housing extending from an enclosed first longitudinal housing end to an enclosed second longitudinal housing end along a central axis and defining an inner surface of a tubular cavity; (ii) an extractor tube arranged within the tubular housing and extending through the first longitudinal housing end, from a first open end proximal the first longitudinal housing end to a second open end within the tubular cavity; and (iii) at least one aperture defined radially though the tubular housing and the inner surface, defined longitudinally at a location between the first longitudinal housing end and the second open end, and formed to create a hydrocyclonic flow about the tubular cavity when a liquid flows into the tubular cavity through the aperture.

In some embodiments, the aperture is formed as a tangential slot extending radially though the tubular housing and the inner surface, and defining a longitudinal channel axis that is parallel or substantially parallel to a tangent line that passes through a point on the inner surface. In some embodiments, the aperture is formed as a helical slot through the tubular housing and the inner surface. In some embodiments, the first open end is configured for connection to a pump configured to draw liquid hydrocarbons into the second open end and through the extractor tube. In some embodiments, the second longitudinal housing end is enclosed by a valve. In some embodiments, the valve is a flapper valve configured to enclose the second longitudinal housing end when fluid pressure within the tubular cavity is less than fluid pressure outside the tubular housing, and open the second longitudinal housing end when fluid pressure within the tubular cavity is equal to or greater than fluid pressure outside the tubular housing.

In some embodiments, the system further includes: (1) a propeller disposed vertically below the separator apparatus and configured to agitate liquids and suspended solids in the wellbore; (2) a second pump; and (3) a fluid conduit configured extract liquids and suspended solids agitated by the propeller by pumping action of the second pump. In some embodiments, the wellbore comprises a tubular wall defining: an inner surface of a wellbore within an oil reservoir formation within the Earth's crust; and a first channel extending radially though the tubular wall and the inner surface, and defining a first longitudinal channel axis that is parallel or substantially parallel to a first tangent line that passes through a first point on the inner surface.

In a sixth aspect, a method for downhole water separation includes (1) providing a separator apparatus comprising: (a) a tubular housing extending from an enclosed first longitudinal housing end to an enclosed second longitudinal housing end along a central axis and defining an inner surface of a tubular cavity; (b) an extractor tube arranged within the tubular housing and extending through the first longitudinal housing end, from a first open end proximal the first longitudinal housing end to a second open end within the tubular cavity; and (c) at least one aperture defined radially though the tubular housing and the inner surface, defined longitudinally at a location between the first longitudinal housing end and the second open end, and formed to create a hydrocyclonic flow about the tubular cavity when a liquid flows into the tubular cavity through the aperture. The method also includes: (2) positioning the separator apparatus downhole, below a surface of the Earth, in a wellbore formed in a geological formation having an emulsion of liquid water and liquid hydrocarbon; (3) flowing the emulsion from the geological formation into the wellbore; (4) drawing a flow of the emulsion through the aperture; (5) contacting the inner surface with the emulsion; (6) redirecting, by the inner surface, the flow into a hydrocyclonic flow about the inner surface; (7) separating, by the hydrocyclonic flow, the liquid water from the liquid hydrocarbon; (8) pumping the separated liquid hydrocarbon though the extractor tube to the surface.

In some embodiments, the aperture is formed as a tangential slot extending radially though the tubular housing and the inner surface, and defining a longitudinal channel axis that is parallel or substantially parallel to a tangent line that passes through a point on the inner surface. In some embodiments, the aperture is formed as a helical slot through the tubular housing and the inner surface. In some embodiments, the pumping the separated liquid hydrocarbon though the extractor tube to the surface comprises drawing the liquid hydrocarbon into the second open end and through the extractor tube.

In some embodiments, the method further includes: (a) reducing pressure within the separator apparatus by the pumping; (b) enclosing the second longitudinal housing end by a valve configured to enclose the second longitudinal housing end when fluid pressure within the tubular cavity is less than fluid pressure outside the tubular housing; (c) collecting the liquid water proximal the second longitudinal housing end; (d) equalizing pressure within the separator apparatus by halting the pumping; (e) opening the second longitudinal housing end when fluid pressure within the tubular cavity is equal to or greater than fluid pressure outside the tubular housing; and (f) flowing the collected liquid water out the second longitudinal housing end through the valve.

In some embodiments, the method further includes: (g) receiving, through a first channel defining a first longitudinal channel axis that is parallel or substantially parallel to a first tangent line that passes through a first point on a wellbore inner surface of a wellbore formed in an oil reservoir formation and extending radially though a tubular wall and the inner surface of the wellbore, the emulsion moving in a linear flow or substantially linear flow along the first longitudinal channel axis from the oil reservoir formation to the wellbore; (h) contacting the wellbore inner surface with the emulsion; (i) redirecting, by the wellbore inner surface, the flow away from the first longitudinal axis and into a second hydrocyclonic flow about the wellbore inner surface; (j) separating, by the second hydrocyclonic flow, the liquid water from the liquid hydrocarbon; and (k) drawing the separated liquid hydrocarbon toward the tubular housing.

In a seventh aspect, a water separation apparatus includes: (1) a tubular housing extending from an enclosed first longitudinal housing end to an enclosed second longitudinal housing end along a central axis and defining an inner surface of a tubular cavity; (2) an extractor tube arranged within the tubular housing and extending through the first longitudinal housing end, from a first open end proximal the first longitudinal housing end to a second open end within the tubular cavity; (3) at least one aperture defined though the tubular housing and the inner surface; and (4) a propeller configured to be driven to urge a hydrocyclonic flow within the tubular cavity.

In an eighth aspect, a method for downhole water separation includes: (1) providing a separator apparatus; (2) positioning the separator apparatus downhole, below a surface of the Earth, in a wellbore formed in a geological formation having an emulsion of liquid water and liquid hydrocarbon; (3) flowing the emulsion from the geological formation through the aperture and into the tubular cavity; (4) driving the propeller; (5) urging, by the propeller, a hydrocyclonic flow of the emulsion within the tubular cavity; (6) separating, by the hydrocyclonic flow, the liquid water from the liquid hydrocarbon; (7) pumping the separated liquid hydrocarbon though the extractor tube to the surface. The separator apparatus includes: (a) a tubular housing extending from an enclosed first longitudinal housing end to an enclosed second longitudinal housing end along a central axis and defining an inner surface of a tubular cavity; (b) an extractor tube arranged within the tubular housing and extending through the first longitudinal housing end, from a first open end proximal the first longitudinal housing end to a second open end within the tubular cavity; (c) at least one aperture defined radially though the tubular housing and the inner surface; and (d) a propeller within the tubular cavity.

The systems and techniques described here may provide one or more advantages. First, certain embodiments of the systems and methods described in this document can provide ways to achieve oil and water separation in an oil well. Second, the systems and methods described in this document can provide a continuous flow of oil and are not restricted by limitations associated with wells designed to reduce or stop water production in an oil well. Third, the systems and methods described in this document can protect downhole artificial lift equipment and surface facilities from corrosive environments. Fourth, the various embodiments described in this document can provide for waste water disposal.

The details of one or more implementations are set forth in the accompanying drawings and the description below. Other features and advantages will be apparent from the description and drawings, and from the claims.

BRIEF DESCRIPTION OF DRAWINGS

The patent or application file contains at least one drawing executed in color. Copies of this patent or patent application publication with color drawing(s) will be provided by the Patent and Trademark Office upon request and payment of the necessary fee.

DETAILED DESCRIPTION

Figure 1:
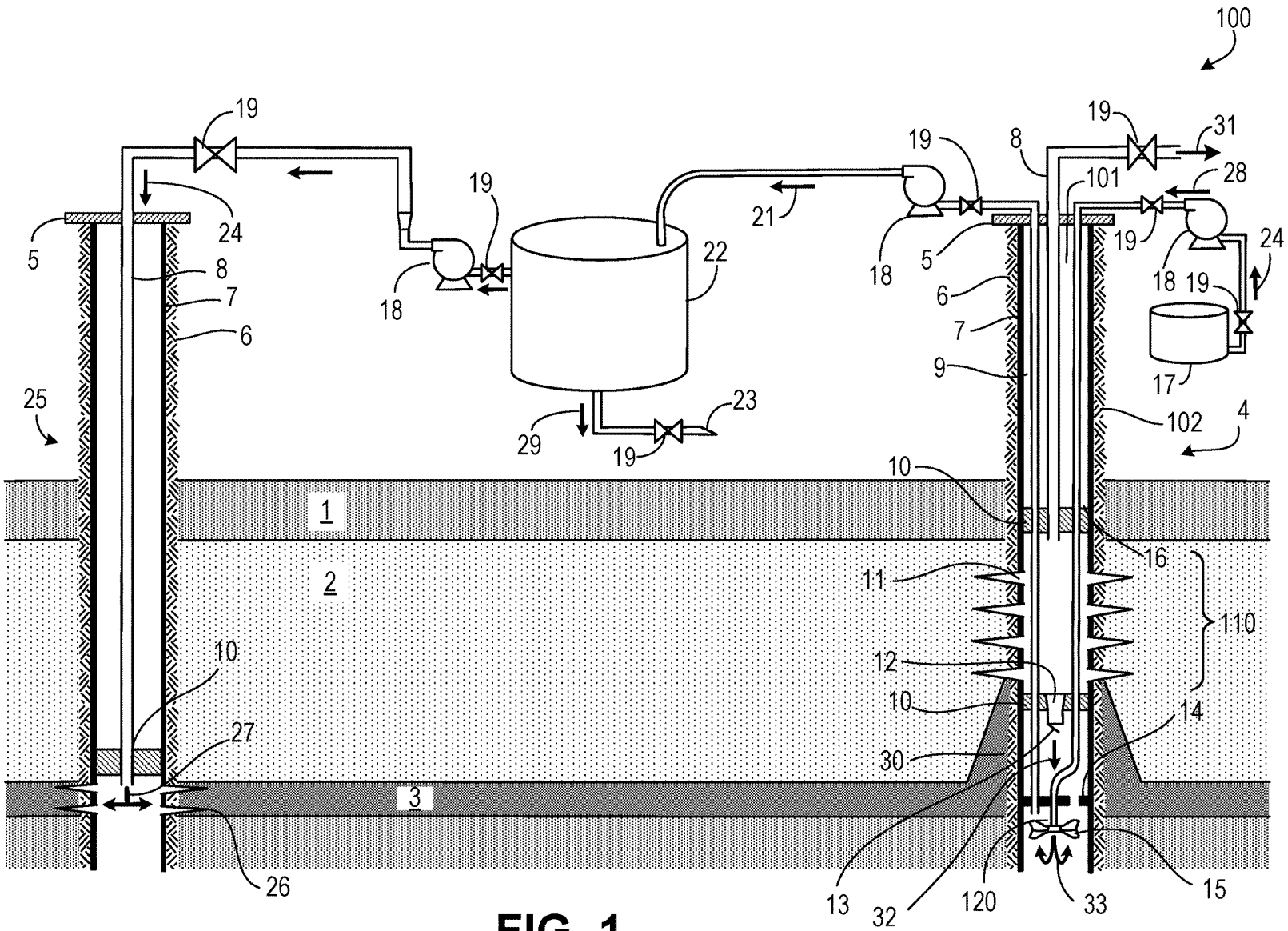
FIG. 1 is a schematic diagram that shows an example oil well system with downhole water separation employing tangential perforations.

This document describes systems and techniques for downhole separation of water from oil or other hydrocarbons produced in an oil well system. As discussed, water may be present in wells. As also indicated, some previous solutions block the production of water into wells, and as such often adversely compromise the oil production capacity of such wells.

Generally speaking, the systems and techniques described in this document take a different approach by creating cyclonic or hydrocyclonic flows downhole to separate water from liquid hydrocarbons such as oil. In some implementations, the separated water can be left downhole while the oil is pumped to the surface. In some implementations, the separated water can be pumped to the surface where it can be processed and reinjected back into the underground formation.

Some examples include a downhole centrifugal operation to separate water from liquid hydrocarbon (oil and gas) entering the wellbore from the hydrocarbon formation or reservoir. Within the wellbore, the centrifugal separation can be performed by generating a spiral or cyclonic flow pattern. As discussed below, such flow patterns can be induced, urged, or generated via wellbore tangential perforations. In other examples, the spiral or cyclonic flow patterns may be generated by a cyclonic separation apparatus (a cyclonic separator) in addition to or in lieu of the wellbore tangential perforations.

The spiral flow pattern within the wellbore may provide for the water as a heavier component to flow outward within the wellbore and down near or along the interior side of wellbore casing. Oil or gas as a lighter component may reside in the middle or center portion of the wellbore and flow upward, for example, through extraction tubing via a motive force such as with a pump. The separated water may flow down the wellbore passing through, for instance, a discharge chute and one-way flapper valve to accumulate deep in the wellbore.

The separated water may have emulsion, sludge, asphaltenes, fine particles or fines, other solid particles, and so forth. Fines may be relatively tiny particles eroded from various types of reservoir rock formations such as sandstones and carbonates. The fine particles may range in size from a few nanometers, such as 10 nanometers, to several micrometers, such as 1000 micrometers. These fines can play a role in creating emulsions and sludge which may be remove from the well-bottom, as discussed.

Reinjection of the separated water with these solid impurities and other impurities may plug or foul the formation where the untreated separated water is being injected. To avoid this potentially adverse scenario, a water removal system may flow the separated water from the wellbore and collect the separated water at the Earth surface. At the surface, the produced water may be filtered and, if desired, chemically treated to remove impurities before reinjecting the treated separate water into another well such as a nearby disposal well The separated water accumulated in the wellbore may be removed from the wellbore, for example, by a surface pump. Further, if employed, a hydraulically-operated propeller system may facilitate removal of accumulated sludge or fines via the removed separated water, as discussed below. In certain examples, the propeller may be driven by pumping additional water from the surface through an inflow tube to and through the propeller. The accumulated sludge and fines may flow with the water (the separated water and the additional water) to the Earth surface through another tube (outflow tube) passing through isolating packers. This produced water, at the surface, may be treated and reinjected back into the water zone for disposal or pressure maintenance. In examples, as mentioned, a separate injection well may be employed for the reinjection.

In summary, the present disclosure provides for innovative techniques of centrifugal water separation, water removal by a surface pump, removal of sludge or fines via a hydraulically-operated propeller, and reinjection of treated water, and so on. Example techniques having aspects of this downhole water separation, removal of water, sludge, fines (or other solids), and water treatment and reinjection systems are described in the text and figures.

FIG. 1 is a schematic diagram that shows an example oil well system 100 with downhole water separation features. The system 100 includes wellbore 4, such as a cased wellbore 4, (that is formed through a cap rock layer 1, a hydrocarbon formation 2 (for example, oil reservoir), and a water layer 3 (for example, aquifer). The wellbore 4 may be for an oil production well. The wellbore 4 includes a casing 7 having a tubular wall that is surrounded or partially surrounded by a layer of cement 6, and extends from a wellhead 5 at the surface down to the hydrocarbon formation 2 underground.

The wellbore 4 defines a tubular cavity 101 having an inner or internal surface 102 The internal surface 102 may be an internal surface of the casing 7 such as the internal surface of the tubular wall of the casing 7. The tubular cavity 101 may have a tubular wall characterized as the casing 7 or its tubular wall, or the combination of the casing 7 or its tubular wall and the layer of cement 6.

An oil tube 8, a water inflow tube 16, and a water outflow tube 9 are disposed within the tubular cavity 101. The tubular cavity 101 is in fluid communication with the hydrocarbon formation 2 by a collection of tangential perforations 11. In some implementations, the tangential perforations 11 can be formed by a tool (not shown) that is positioned downhole and configured to perforate the casing 7, cement 6, and part of the formation 2 and form channels that are tangent or substantially tangent to the casing 7 or internal surface 102. Substantially tangent may be less than 5° deviation from tangent, or that the channel intersects the tangent point at an angle of less than 5° with respect to the surface 102.

In operation, as oil and water emulsions flow from the hydrocarbon formation 4 through the tangential perforations 11, the tangential orientation of the perforations 11 urges the emulsion into a rotational vortex in the tubular cavity 101 that separates the oil from the water. As discussed below, the separated oil 31 is pumped to the surface and the separated water 32 flows downward.

Figure 2:
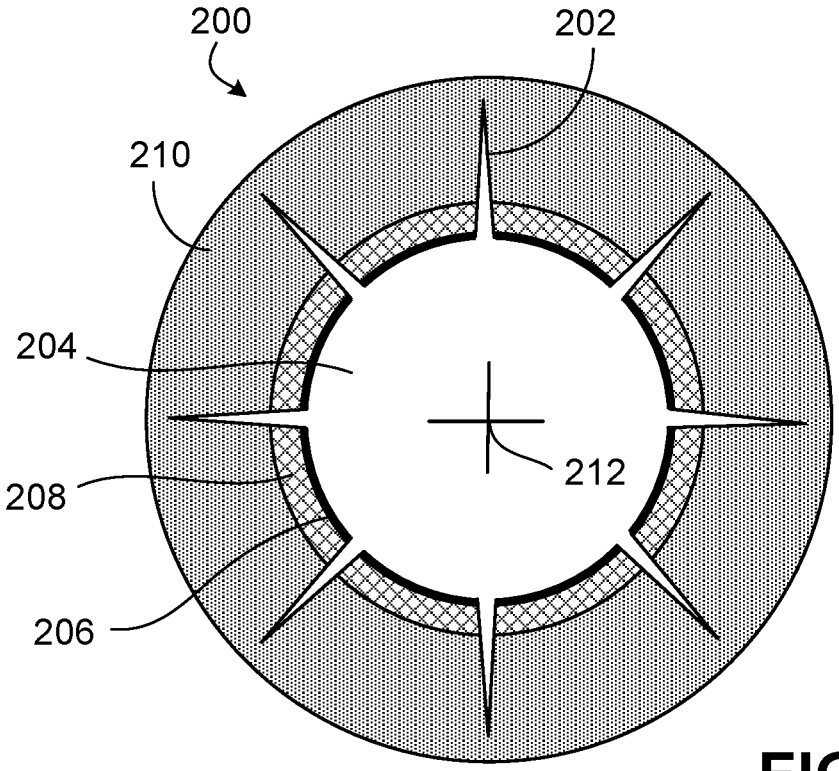
FIG. 2 is a cross-sectional view of a cased wellbore with radial perforations.

Referring now to FIG. 2, a cross-sectional view of a cased wellbore 200 with a collection of radial perforations 202 is shown for purposes of comparing and contrasting a conventional configuration of wellbore perforations to the example tangential perforations 11 of FIG. 1. The cased wellbore 200 has a hole or wellbore that is a tubular cavity 204 into the Earth.

The radial perforations 202 are formed through the casing 206, the cement 208, and into the hydrocarbon formation 210. The radial perforations 202 define fluid channels that provide a fluid path for hydrocarbons to flow from the hydrocarbon formation 210 into the tubular cavity 204 defined by the casing 206. The radial perforations 202 are radially aligned with a central axis 212 of the wellbore 200.

Figure 3:
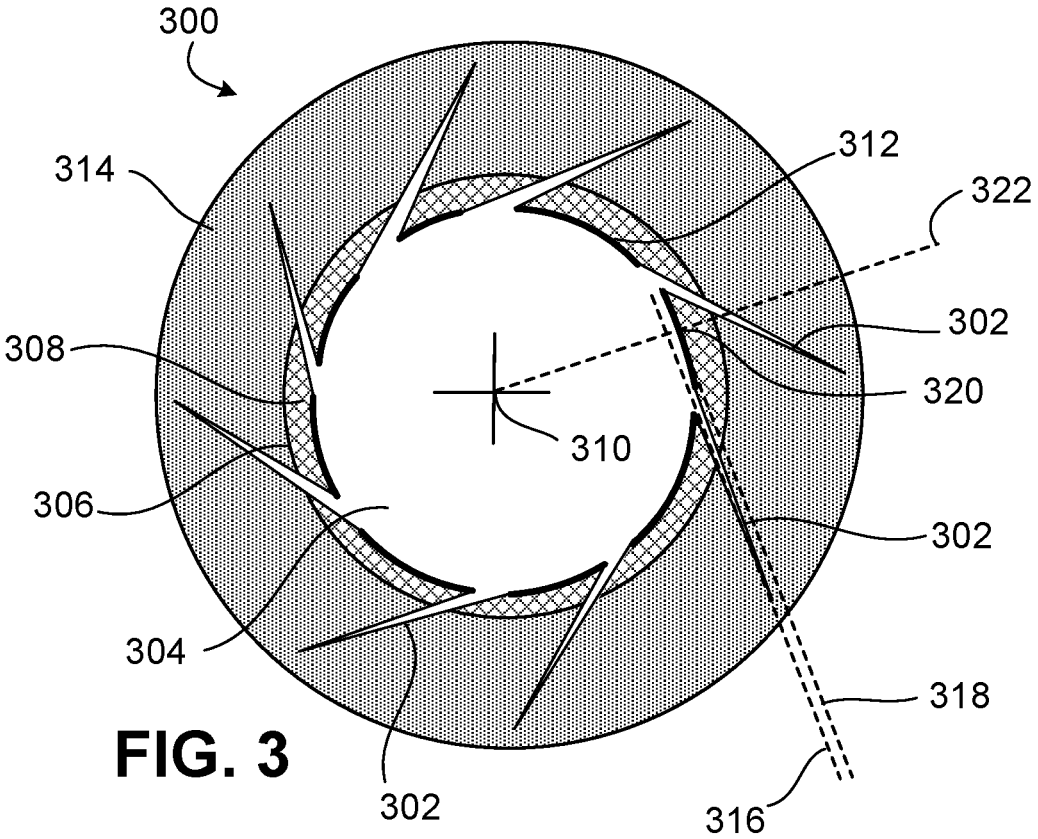
FIG. 3 is a cross-sectional view of a cased wellbore with tangential perforations.

Referring now to FIG. 3, a cross-sectional view of an example cased wellbore 300. In contrast to the radial perforations of 202 of FIG. 2, the wellbore 300 includes a collection of tangential perforations 302. In some embodiments, the wellbore 300 can be the example wellbore 4 of FIG. 1, and the tangential perforations 302 can be the example tangential perforations 11.

The wellbore 300 includes a casing 304 that is surrounded by cement 306. The casing 304 provides a tubular wall that defines a tubular cavity 308 with a central axis 310, and has an inner surface 312. Each of the tangential perforations 302 defines a channel that extends tangentially though the casing 304, the inner surface 312, and partly into the hydrocarbon formation 314. Each of the tangential perforations 302 defines a longitudinal channel axis 316 that is parallel or substantially parallel to a tangent line 318 that passes through a point 320 on the inner surface 312. Substantially parallel may mean less than 5° deviation from parallel, or that the longitudinal channel axis 316 intersects the tangent line 318 at an angle of less than 5°. The point 320 and the central axis 310 define a radial line 322.

In some embodiments, the tangential perforations 302 and the longitudinal channel axes 316 may each be angled away from their respective tangent line 318 by +/−45°. For example, the longitudinal channel axis 316 can intersect the radial line 322 at angles ranging from about 45° to about 135° (for example, pointing "clockwise" with reference to FIG. 3) or from about 225° to about 315° (for example, pointing "counterclockwise" with reference to FIG. 3).

The tangential perforations 302 are formed to have a cooperative orientation (for example, all clockwise or all counterclockwise). For example, a second tangential perforation 302 can define a second channel that extends radially though the tubular wall and the inner surface 312. The second channel can define a second longitudinal channel axis that is parallel or substantially parallel to a second tangent line that passes through a second point spaced apart from the point 320 on the inner surface 312. The tubular wall can also define a second radius extending radially from the central axis 310 to the second point, and the second longitudinal channel axis and the second radius can form a second angle that is within the same range of about 45° to about 135° (for example, pointing "clockwise" with reference to FIG. 3) or from about 225° to about 315° (for example, pointing "counterclockwise" with reference to FIG. 3) as the first angle.

Liquids including emulsions of water and oil (or other liquid hydrocarbons) are trapped in the hydrocarbon formation 314. Pressures within the hydrocarbon formation 314 urge the emulsion into the tangential perforations 302 and cause a lateral fluid flow along the longitudinal channel axis 316 toward the tubular cavity 308. When the lateral fluid flow enters the tubular cavity 308, the flow will encounter the inner surface 312 of the casing 304. The curvature of the inner surface 312 redirects the linear flow into a rotational (for example, orbital, cyclonic, hydrocyclonic) flow about the central axis 310.

Figure 4:
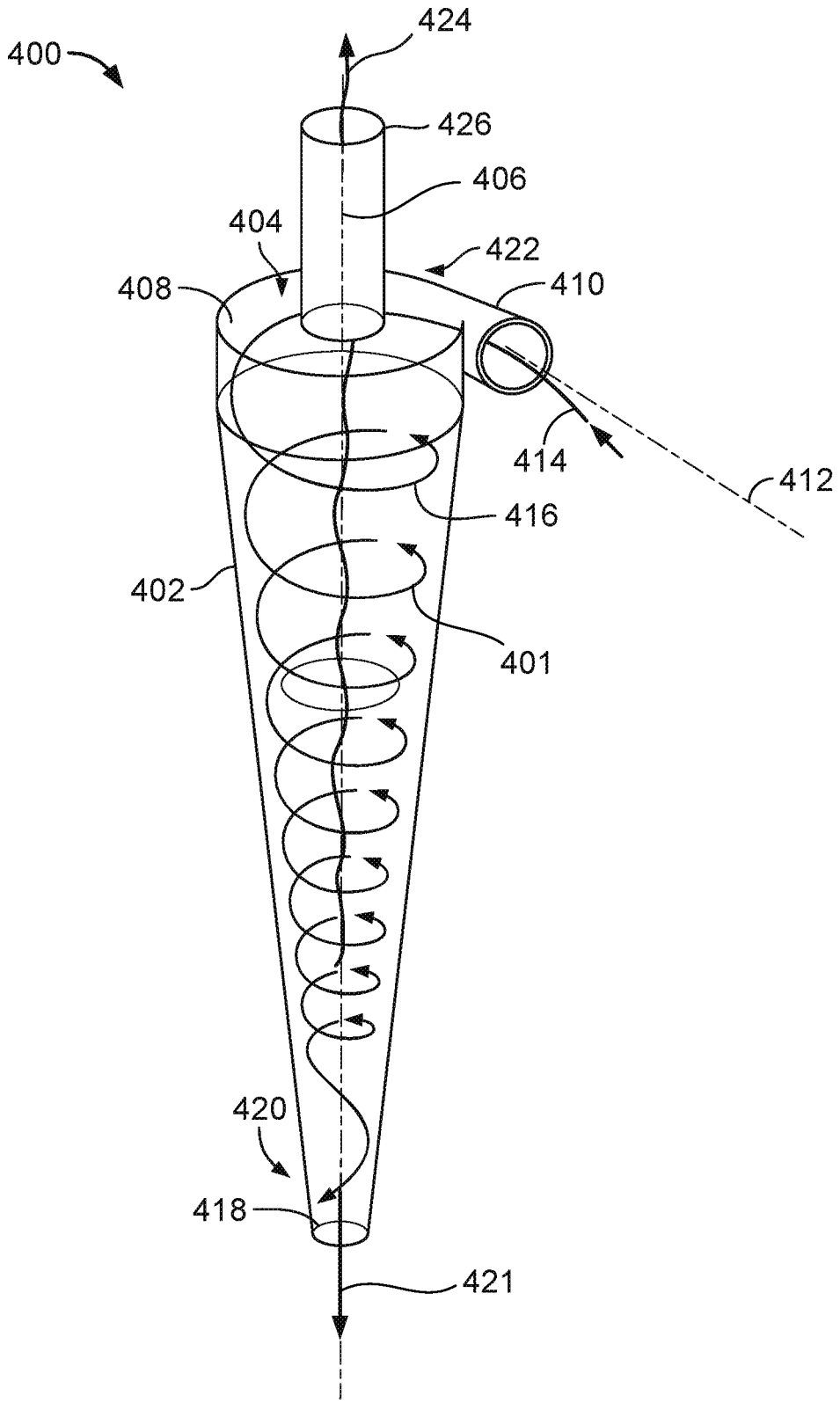
FIG. 4 is a conceptual illustration of a hydrocyclone for water separation.

FIG. 4 is a conceptual illustration of a hydrocyclone 400 for water separation. In some embodiments, the hydrocyclone 400 can be a part of the example wellbore 4 of FIG. 1 and wellbore 300 of FIG. 3, or can be a downhole separator or a part of a downhole apparatus positioned downhole in the wellbore 4, 300.

In general, emulsions of liquids will separate due to differing densities or buoyancies of the liquids in the mixture. Gravity can provide the acceleration force that can cause an emulsion to separate. For example, an emulsion of oil and water may separate if left undisturbed, with the oil floating to the top and the water sinking to the bottom. However, in a downhole environment, the flows of fluids into the tubular cavity 308 (FIG. 3) provide an agitation that can slow or prevent the separation of fluids due to the force of gravity alone. In general, the hydrocyclone 400 creates a rotational (for example, orbital, cyclonic, hydrocyclonic) flow 401 that provides a centripetal acceleration to an emulsion that can cause the fluid mixture to separate.

In the illustrated example, the hydrocyclone 400 includes a tubular wall 402 defining a tubular cavity 404 with a central axis 406, and has an inner surface 408. A tangential channel 410 extends through the tubular wall 402 and the inner surface 408. A linear flow 412 of an emulsion 414 (for example, at least oil and water) is represented by the line 412. As the emulsion 414 flows linearly 412 into the tubular cavity 404, the flow 412 contacts the inner surface 408 and is redirected into a vortex (for example, rotational, orbital, cyclonic, hydrocyclonic) flow 401 pattern 416 about the central axis 406.

The centripetal acceleration caused by the vortex flow pattern 416 urges the emulsion 414 to separate, with the denser fluid(s) migrating radially away from the central axis 406 and with the less dense fluid(s) migrating radially inward toward the central axis 406. With the hydrocyclone 400 oriented such that the central axis 406 is vertical relative to gravity, the separated denser fluid(s) will sink toward an underflow outlet 418 at a lower end 420 of the hydrocyclone 400 under the force of gravity. The separated denser fluid(s) 421 may discharge through the outlet 418. The separated lighter fluid(s) will rise toward an overflow outlet 460 located proximal the central axis 406 at an upper end 422 of the hydrocyclone 400. In an oil well application, the hydrocyclone 400 can separate or substantially separate an emulsion of oil and water in which separated water will flow out the underflow outlet 418 and separated oil 424 will flow out the overflow outlet 426.

With respect to downhole water removal and well cleaning, the separated water as indicated may accumulate at the bottom or bottom portion of the wellbore. See, for example, FIG. 1 and FIG. 6. As discussed below, the accumulated water may be removed by a surface-based pumping system. In some implementations, the surface pump can be operated manually or automatically in response to the volume of the downhole accumulated water reaching a preset threshold.

In certain examples, because of accumulated mix of sludge, fines, or emulsions, the bottom portion of the wellbore may benefit from cleaning. Thus, as discussed, a hydraulically-operated propeller system (see, for example, FIGS. 1, 6, and 7) may be implemented. The propeller may be installed on a centralizer near a bottom of the well or wellbore where the sludge, fines, or emulsion may accumulate intermittently or generally continuously. The centralizer may maintain the propeller in the middle or center portion of the wellbore and provide rigidity during propeller rotation. The propeller rotation may be activated by relatively high-pressure water pumping from the surface through a water inflow conduit or tube to the propeller. This injected water from the surface may enter through the inflow tube into a top portion of the propeller to rotate the propeller, and exit from a bottom portion of the propeller. This injected water exiting the propeller may mix with the accumulated sludge, emulsion, and fines at the lower portion of the wellbore and facilitate carrying the sludge, emulsion, and fines out of the well through an outflow conduit or tube to the Earth surface. See, for example, FIGS. 1, 6, and 7.

Returning now to FIG. 1, the tangential perforations 11 along a section of the wellbore 4 form a hydrocyclone 110 in operation. The hydrocyclone 110 has the casing 7 or section of the casing 7 as a component. As oil and water emulsions flow from the hydrocarbon formation 4 through the tangential perforations 11 into the tubular cavity 101, the hydrocyclone 110 urges the emulsion into a rotational vortex that separates the oil from the water. The separated oil 31 is sent out of the wellbore 4 through a tubing 8 to an outlet 20 at the surface. The separated oil may be conveyed through the tubing 8 to the surface by natural reservoir pressure, a pump, or both, and so on. The separated water 32 sinks downward toward a packer 10, flowing out through an underflow outlet 12 (for example, discharge chute) having a one-way valve 13 (for example, a flapper valve or flip valve) into a lower chamber 120. In examples, the lower chamber may be the well-section starting from the lower packer 10 to the well bottom.

The lower chamber 120 includes a centralizer 14 configured to position a propeller 15 centrally within the wellbore 4. The propeller 15 is hydraulically actuated. In particular, water such as clean water 24 from a water storage vessel 17 is pumped downhole through a water inlet tube 16 to drive, rotate, or power the propeller 15. Both this water 28 flowing through the propeller 15 to drive the propeller 15 and also the separated water 32 may accumulate in the lower chamber 120. The hydraulic propeller 15 is operated to agitate this water 33 in the lower chamber 120 and cause debris (for example, mud, fines) in the lower chamber 120 to become suspended in the water 33. This water 33 may include, for example, the separated water 32 plus the water 28 discharged by the propeller 15. The suspension is pumped by a surface pump(s) 18 up through a water outflow tube 9 to a water treatment unit 22 at the surface. The propeller 15 and associated pumped injected water 24 may also provide additional motive force for flow of the suspension up through the water outflow tube 9. See the similar discussion with respect to FIG. 6 in regard to lifting of water from the chamber to the surface, which is also applicable to the system 100 in FIG. 1. This water sent to the treatment unit 22 may be labeled as produced water 21. Valves 19 may be associated with the piping in the handling and transport of water or other fluids.

The water treatment unit 22 treats the produced water 21 to separate suspended solids, and remove any remaining oils, hydrocarbons, or other contaminants. The bottoms discharge 29 may include solids, sludge, and other contaminants removed from the water treatment unit 22 and sent to a waste disposal system 23. Clean water 24 from the treatment unit 22 is pumped to a water injection well 25 or to the propeller 15. Clean water 24 provided to the water injection well 25 is injected back to the water layer 3, for example, to replenish the aquifer to maintain hydrostatic pressure within the water layer 3 or the hydrocarbon formation 2, or combinations thereof. For instance, water 27 may injected through the perforations 26 into the water layer 3. Lastly, water coning 30 may be associated with the water layer 3.

During the water removal cycle from the bottom of well, maintaining the one-way flapper valve closed (against upward flow) is generally beneficial. Such may be implemented with the one-way flapper valve as a mechanically or electrically controlled valve. Similarly, during well-cleaning, the flapper valve should generally be closed mechanically or electrically in examples. Moreover, for well-cleaning in certain implementations, the flapper can be closed hydraulically by keeping the water-injection pressure below the bottom packer in the wellbore higher than the production pressure between the bottom packer and the upper packer. In other words, differential pressure upward across the bottom packer may close the flapper valve during the cleaning cycle. In a particular implementation, this differential pressure across the bottom packer is controlled by adjusting the water injection pressure and a back-pressure regulator installed at the outlet end of the outflow tube.

Based on the water accumulation rate and well-cleaning frequency, the water pumped to the propeller to drive the propeller may be turned on/off and the water injection rate (to the propeller 15) adjusted manually or automatically by a remote control system. To process increased or continuous water production scenarios, the water suction system via the surface pump 18 may be maintained running on a continuous or semi-continuous basis. Yet, increased or continuous water production 21 may not be experienced with low water-cut wells. As indicated, the water 21 produced may be treated at the surface before reinjection back into the aquifer 3. Again, in some examples, the reinjection is implemented at another well located nearby.

Figure 6:
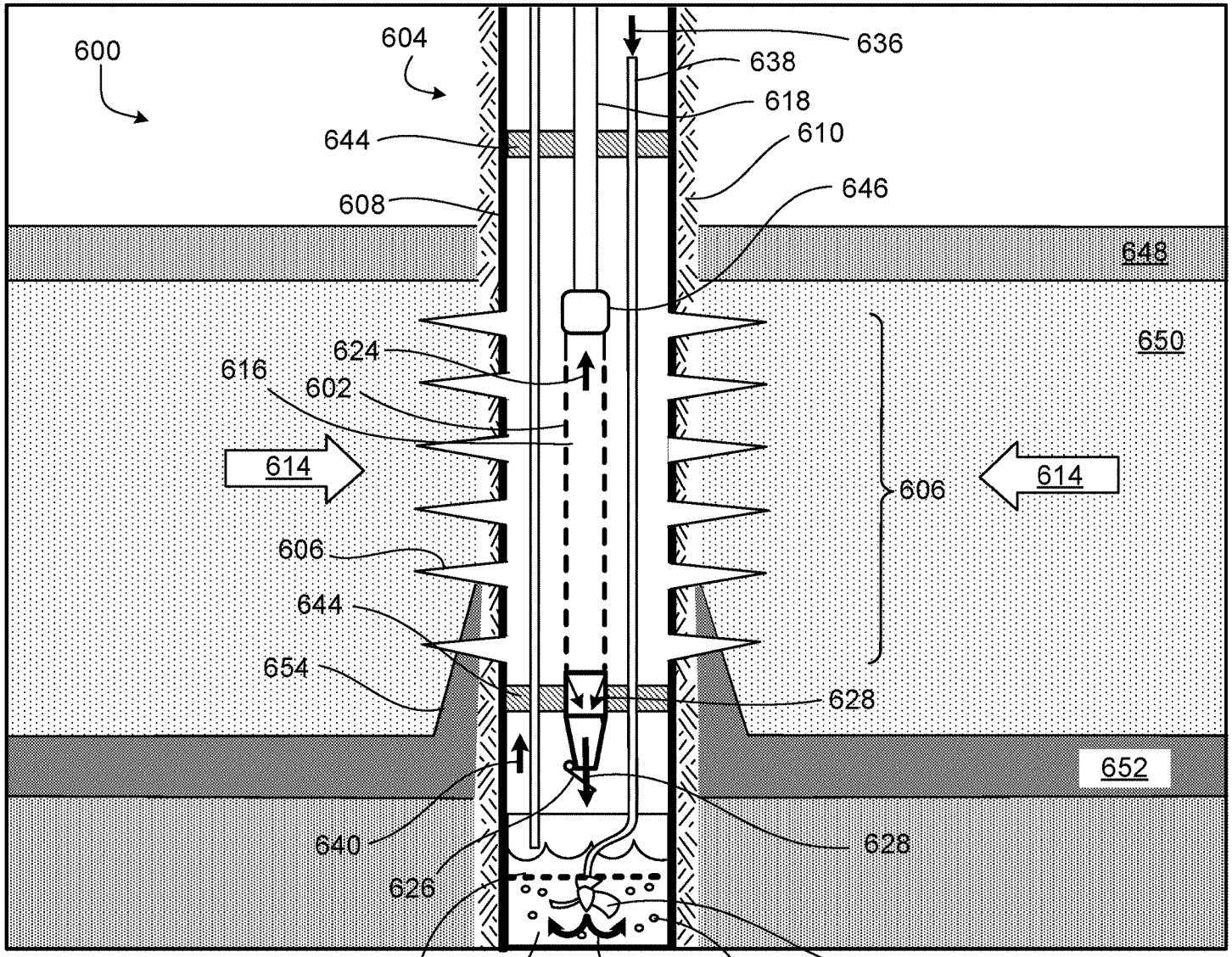
FIG. 6 is a schematic diagram that shows an example oil well system with downhole water separation employing a separator with apertures, such as a slotted separator, coupled to discharge tubing.

In examples, the wellbore is located in a relatively high-pressure reservoir 2. That high-pressure generally facilitates generating cyclonic fluid-flow pattern and separation when fluids pass through the tangential perforations (or into a centrifugal separator as depicted in FIG. 6). Moreover, in some implementations with a higher reservoir pressure, pump to push the separated oil to the surface may be avoided. The oil may flow to the surface via the natural reservoir pressure. However, when natural reservoir pressure is relatively low, then an additional downhole pump such as an electrical submersible pump (ESP) can be installed to help produce the separated oil. Such pumps are usually installed (or hanged) at the end of tubing string 8. Similarly, in FIG. 6, if the pressure is low, an ESP can be added on the outlet extraction tubing.

Figure 5A:
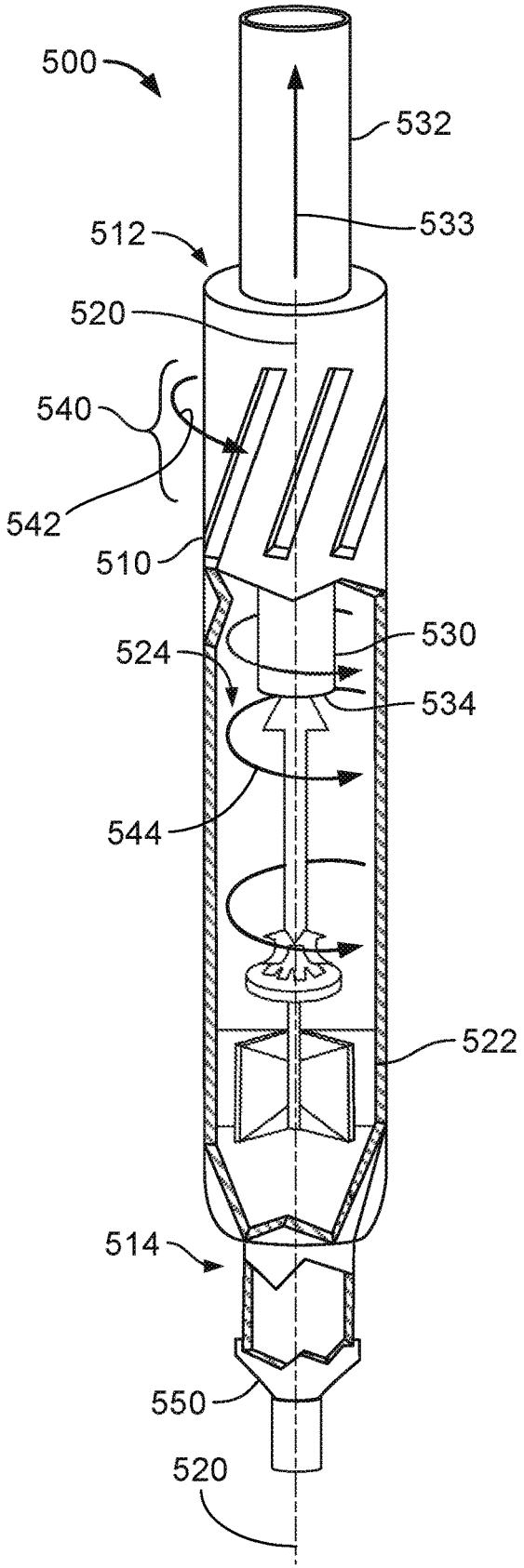
FIGS. 5A and 5B are partial cutaway views of a downhole water separator.
Figure 5B:
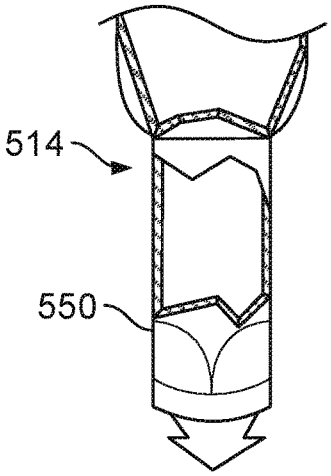

FIGS. 5A and 5B are partial cutaway views of a downhole water separator or separator apparatus 500. In general, the separator or apparatus 500 is a portable (for example, positionable, moveable) device that may be installed downhole and that is a hydrocyclone to process an emulsified mix of fluids as feed. For example, the apparatus 500 can be used to separate oil from water in a downhole application.

The apparatus 500 includes a tubular housing 510. The tubular housing 510 extends from an enclosed or partially-enclosed upper (for example, relative to gravity) longitudinal housing end 512 to an enclosed or partially-enclosed lower longitudinal housing end 514. The tubular housing 510 defines and extends along a central axis 520, and defines an inner surface 522 of a tubular cavity 524. An extractor tube 530 is arranged within the tubular housing 510. The extractor tube 530 extends through the longitudinal housing end 512, from an open end 532 proximal the longitudinal housing end 512 to an open end 534 within the tubular cavity 524.

A collection of apertures 540 are defined radially though the tubular housing 510 and the inner surface 522. The apertures 540 are defined longitudinally at a location between the longitudinal housing end 512 and the open end 534. The apertures 540 are formed to create or generate a hydrocyclonic flow 542 about the tubular cavity 524 within when a liquid (for example, emulsified oil and water) flows into the tubular cavity 524 through the apertures 540.

In the illustrated example, the apertures 540 are formed as helical ports in the tubular housing 510. In operation, as a liquid flows into the tubular cavity 524, the helical shapes urge the flow to rotate in a predetermined direction 544 about the axis 520. The flow is further directed into a cyclonic or hydrocyclonic flow (direction 544) by the curvature of the inner surface 522. In other examples, the apertures 540 can be formed as tangential slots extending radially though the tubular housing 510 and the inner surface 522, in which each of the tangential slots defines a respective longitudinal channel axis that is parallel or substantially parallel to a tangent line that passes through a point on the inner surface 522. For example, the apertures 540 can be formed similar to the example tangential perforations 11 or 302 of FIGS. 1 and 3, or the example tangential channel 410 of FIG. 4. The apertures 540 may be other types of tangential slots or orifices.

In operation, emulsified oil and water flows about the axis 520 in a cyclonic or hydrocyclonic vortex. Centripetal acceleration caused by the rotational flow causes the oil to migrate toward the axis 520 while urging the water to migrate away from the axis 520. The open end 532 is located proximal the axis, for example, where the separated oil 533 discharges. In some examples, the natural reservoir pressure provides motive force for conveyance of the separated oil 533 through the open end 532 and a conduit or tubing such as the extractor tubing 530 to the Earth surface. In certain examples, the open end 532 is hydraulically coupled to a suction of a pump (not shown) configured to draw oil or other liquid hydrocarbons into the open end 534 and through the extractor tube 530 (for example, up to the surface). The pump may rely on the natural reservoir pressure to increase the net positive suction head (NPSH) of the pump. In use, the extraction of fluid from the tubular cavity 524 causes additional liquid to be drawn in though the apertures 540 in a flow, and the flow can interact with the apertures 540 to create further cyclonic or hydrocyclonic action. For example, the pumping can power the hydrocyclone.

The longitudinal housing end 514 is enclosed by a flapper valve 550 which may be a valve coupled to the separator 500 or a valve as a component of the separator 500. The flapper valve 550 is configured to enclose the longitudinal housing end 514 when fluid pressure within the tubular cavity 524 is less than fluid pressure outside the tubular housing 510 (for example, the valve is drawn shut by suction). Referring to FIG. 5B, the flapper valve 550 is configured to also open the longitudinal housing end 514 when fluid pressure within the tubular cavity 524 is equal to or greater than fluid pressure outside the tubular housing 510. In use, the separated water (and solids) collects in the lower end of the apparatus 500 near the flapper valve 550 while the pump is active (for example, as shown in FIG. 5A). In examples, when the pump is stopped or shut off, the flapper valve 550 opens and allows the separated water and solids to flow out such as to sink downhole.

In some implementations, the apparatus 500 may be configured to actively create or enhance the hydrocyclonic flow. For example, the tubular housing 510 may be rotated to urge rotation of emulsified fluids within the tubular cavity 524. In another example, a propeller or impeller may be included within the cavity 524 to urge rotation of emulsified fluids within the tubular cavity 524. However, the separator apparatus 500 may not include a propeller or impeller if such inhibited or interfered with the cyclonic flow or cyclonic separation in the tubular cavity 524.

The water separator apparatus 500 can be used in addition to (or instead of) the example hydrocyclone 110 (tangential perforations 11) of FIG. 1. For example, the apparatus 500 can be positioned downhole proximal the example tangential perforations 11 of FIG. 1 or the example tangential perforations 302 of FIG. 3 to form a two-stage hydrocyclonic fluid separator (for example, a hydrocyclone within a hydrocyclone). In other examples, the apparatus 500 can be positioned within a wellbore having non-tangential perforations (for example, the example wellbore 200 of FIG. 2 having the radial perforations 210) to urge a hydrocyclonic flow of downhole fluids. The tangential perforations 11 or 302 can create a first hydrocyclonic flow that performs a first stage separation of water from oil. However, in this example, the oil at this stage may still include an amount of water. The water separator apparatus 500 can be positioned within the separated oil such that the separated oil flows into the apparatus 500 and into a second hydrocyclonic flow within the apparatus 500 to perform a second stage separation of remaining water from the oil. The twice-separated oil can then be drawn through the extractor tube 530 and pumped to the surface.

FIG. 6 is a schematic diagram that shows an example oil well system 600 with downhole water separation features. In some embodiments, the oil well system 600 can be a modification of the example system 100 of FIG. 1, in which the hydrocyclone 110 (perforations 11) is replaced by or is in addition to a downhole water separator or separator apparatus 602. Indeed, the many various features of FIG. 1 including the surface equipment and operation are in the oil well system 600.

The separator 602 provides for hydroclonic separation of water from hydrocarbon such as oil and gas. The separator 602 may be a hydrocyclone. In some embodiments, the separator or separator apparatus 602 can be the example downhole water separator apparatus 500 of FIGS. 5A-5B. In other embodiments, the separator apparatus 602 may be a separator 602 having a configuration or operation different than the water separator apparatus 500.

In the illustrated example, the separator or apparatus 602 is positioned downhole within a wellbore 604 adjacent or near a collection of perforations 606 (radial or tangential) formed though a casing 608 and cement 610 and partway into the hydrocarbon formation 612. Pressures within the formation 612 urge emulsions 614 of oil and water to flow through the perforations 606 to the apparatus 602. The emulsion 614 then flows through a collection of apertures 616 in the apparatus 602 (for instance, the example apertures 540 of FIG. 5A) into a tubular cavity of the separator apparatus 602. The apparatus 602 may include or be coupled to extraction or discharge tubing 618 for the separated oil.

The collection of apertures 616 is depicted represented as a dashed line for clarity. The apertures 616 may be in the outer wall of the separator 602 and give tangential entry of the emulsion into the separator 602. The apertures 616 may be in a cooperative orientation to promote radial flow of the received emulsion. The apertures 616 may have a geometry and orientation as a tangential entry into the separator 602 to give cyclonic flow and separation in the tubular cavity of the separator 602. In examples, the separator 602 is a hydrocyclone with more than one tangential entry for the feed. Indeed, the collection of apertures 616 may include at least six apertures 616. The number of apertures may be 4, 6, 8, 10, 12, 15, 20, or more. The apertures 616 may be slots or tangential slots, ports, helical ports, orifices, oval orifices, a cyclone screen, and the like.

In certain implementations in operation of the apparatus 602, water 628 from the emulsion 614 may flow down such as in a radial region near the inner wall of the tubular cavity of the apparatus 602. Oil and gas may flow upward through the tubular cavity and into the discharge tubing 618, as indicated by arrow 624.

As indicated, the apparatus 602 urges a cyclonic or hydrocyclonic flow of the emulsion that causes the oil and water to separate. Hydrocyclonic flow may be defined as cyclonic flow of liquids and in which the liquids may incorporate solids or gas. Separated oil is sent to the surface through the tubing 618 as an extraction tube. Separated water flows through a valve 626 out the bottom of the apparatus 602, as indicated by arrows 628, and sinks downhole to a lower chamber 630. In examples, the lower chamber may be a wellbore 604 section from the lower packer 644 to the bottom of the wellbore 604. Water may accumulate in the lower chamber 630. The valve 626 may be, for example, a one-way flip valve or flapper valve.

The lower chamber 630 includes a centralizer 632 configured to position a propeller 634 centrally within the wellbore 604. The propeller 634 is hydraulically actuated. In the illustrated embodiment, water 636 is pumped downhole through a water inlet tube 638 to drive, power, or rotate the propeller 634. The propeller 634 is operated (rotated) to agitate water in the lower chamber 630 and cause debris 637 (for example, mud, fines, other solids) in the lower chamber 630 to become suspended in the water. The debris 637 may become suspended in the water in the chamber 630 or lower section of the wellbore. The water in the chamber 630 may be, for example, the separated water 628 and also the water 636 discharged by the propeller 634. The lower chamber 630 may include a circulation (outlet) flow 639 for the water and suspension. The surface pump 18 providing the injection water 636 may provide for backpressure in the chamber 630 to maintain the valve 626 when desired.

The suspension (of solids or debris 637 in water) is pumped up, as indicated by arrow 640, from the lower chamber 630 through a water outflow tube 642 to the surface. In certain examples, this water removal and well cleaning via the propeller 634 system and surface pumps 18 can be contemporaneous with the oil production above from the upper zones which is generally not stopped during the water removal. In the illustrated embodiment, a surface pump 18 is disposed on or coupled with the outlet flow tube 642 to pull the water. The other surface pump 18 providing the injected water 636 through the propeller 634 may provide NPSH for the downstream surface pump 18 pulling suction. In other examples, the second surface pump 18 pulling suction from the chamber 630 is not utilized. Instead, the first surface pump 18 pumps the injected water 636 through the propeller 634 and also the water from the lower chamber through the water outflow tube 642 to the surface. Other configurations are applicable.

The wellbore 604 may include packers 644 such as an upper packer and lower packer. In some implementations, the apparatus 602 or oil well system includes one or more supports such as a support hanger 646 for the apparatus 602. In certain embodiments, the apparatus 602 can be positioned through cap rock 648 and into a gas reservoir 650 and water aquifer 652. In this example, the gas reservoir 650 is the hydrocarbon formation 612. Lastly, water coning 654 associated with the aquifer 652 may be experienced.

Figure 7:
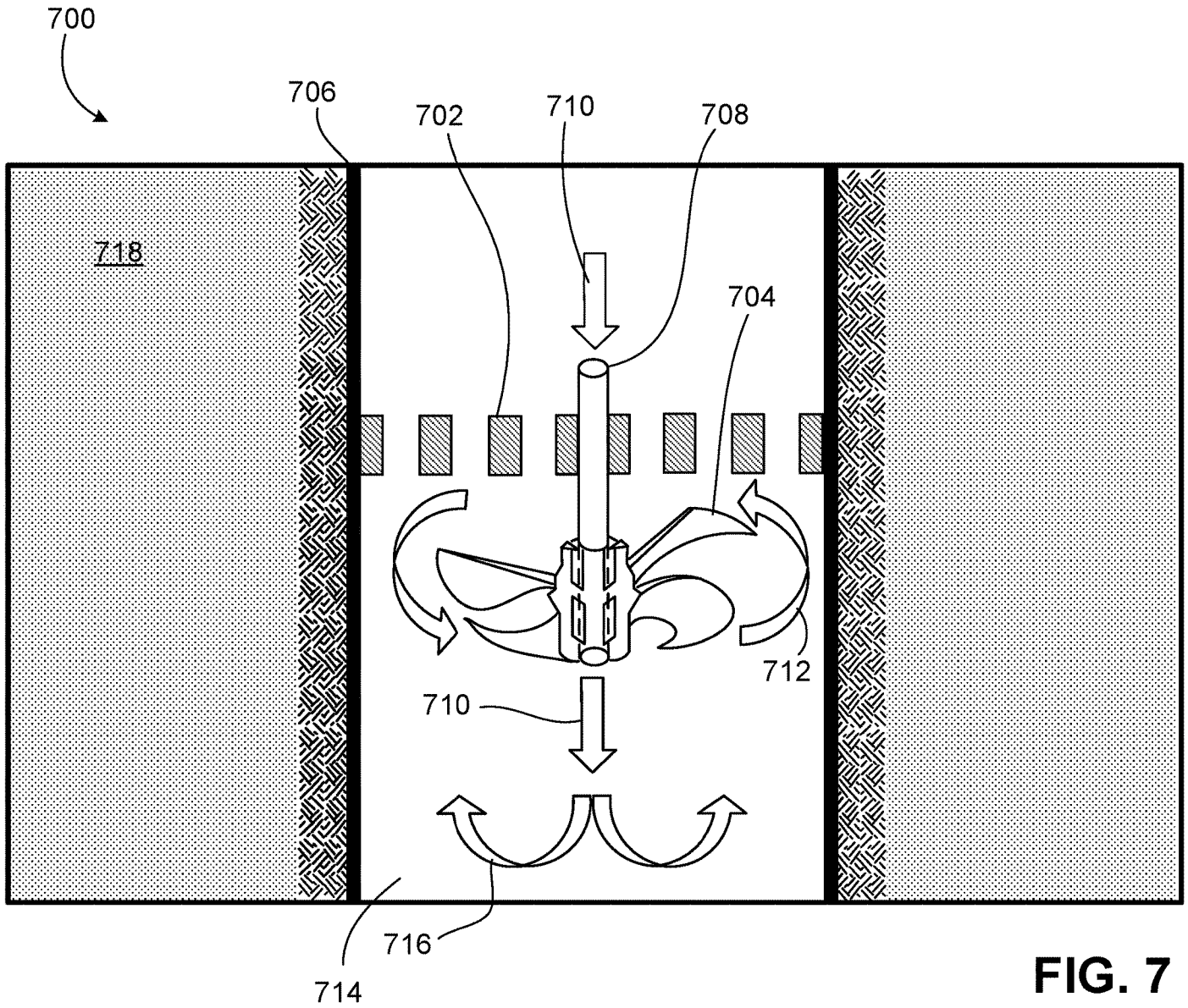
FIG. 7 is a schematic diagram of a downhole well cleaning system.

FIG. 7 is a schematic diagram of an example downhole well cleaning system 700. The system includes a centralizer 702 configured to position a propeller 704 centrally within a wellbore 706. The propeller 704 is hydraulically actuated, and water is pumped downhole through a water inlet tube 708 to receive water 710 to drive or power the propeller 704. The propeller 704 is operated (rotated 712) to agitate water in a lower chamber 714 and cause debris (for example, mud, fines) in the lower chamber 714 to become suspended in the water 716 (for example, the separated water and water 710 discharged by the propeller 704). In some embodiments, the suspension can be pumped out of the lower chamber 714. For example, the water 716 may be pumped to the surface to be recovered for use in powering the propeller 704 or to be reinjected into the formation 718 elsewhere, and so forth. In some embodiments, some or all of the system 700 can be used with the example systems 100 or 600 of FIGS. 1 and 6. For example, the propeller 704 can be the propeller 15 or 634. The lower chamber 630 and internals can be analogous to the lower chamber 714 and internals.

Moreover, a hydraulic propeller different than the example hydraulic propeller depicted in FIG. 7 can be employed in view of, for example, the quantity or frequency of sludge accumulation and removal. For instance, to address propeller wing erosion, the propeller can be a long hollow thick-walled, hydraulically-operated, screw-type propeller to improve longevity of the well-cleaning system. Various types of propellers may be employed, including those not hydraulically operated.

Figure 8:
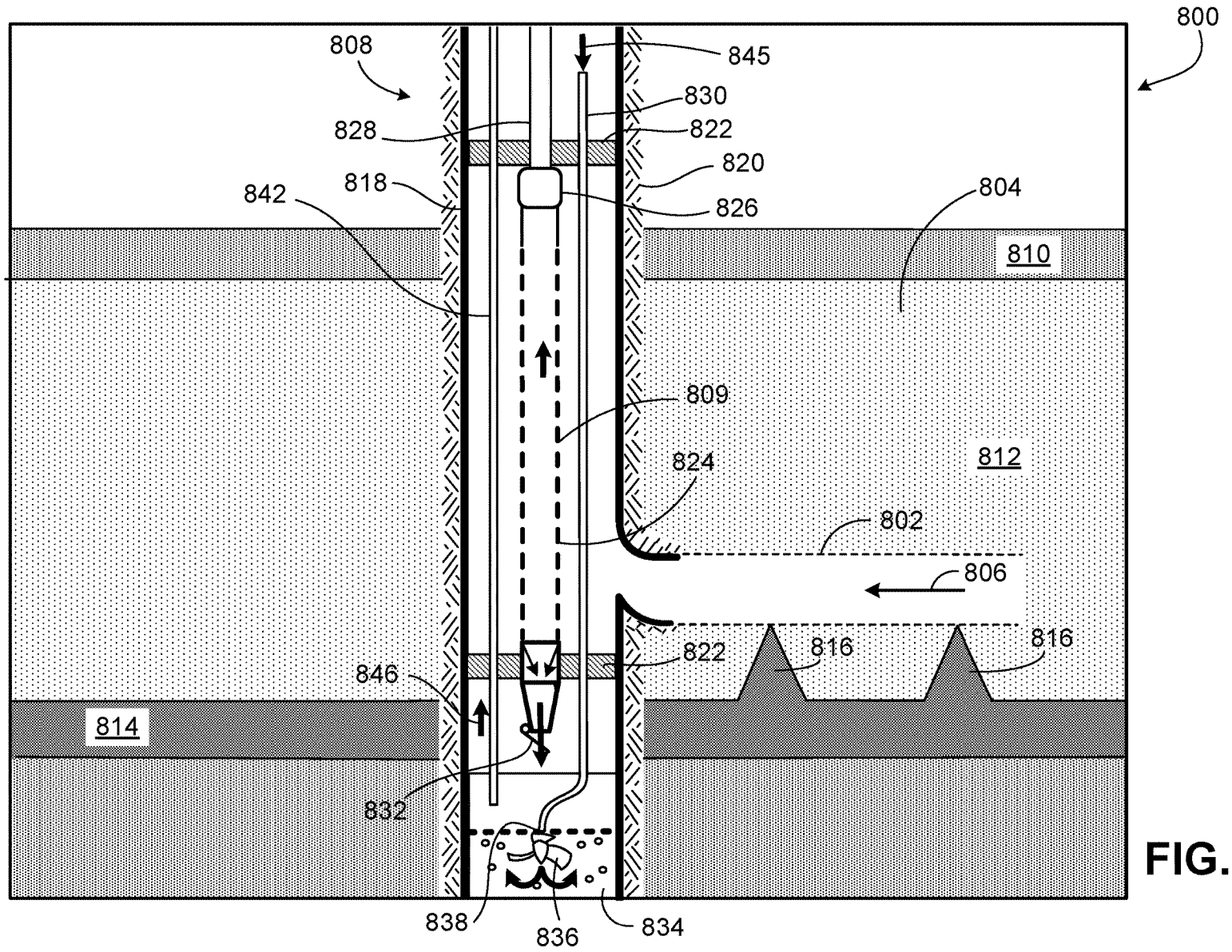
FIG. 8 is a schematic diagram that shows an example horizontal oil well system with downhole water separation employing the same or similar separator of FIG. 6.

FIG. 8 is a schematic diagram that shows an example horizontal oil well system 800 with downhole water separation features. In some embodiments, the oil well system 800 can be a modification of the example system 600 of FIG. 6, in which some or all of the example perforations 606 are replaced by one or more horizontal wellbores 802 formed in the hydrocarbon formation 804. Pressures within the formation 804 urge emulsions 806 of oil and water to flow through the horizontal wellbore 802 to a vertical wellbore 808 and to the example apparatus 809 (which may be analogous to the apparatus 602 of FIG. 6) which separates the oil from the water downhole within the vertical wellbore 808. In the illustrated embodiment, the system 800 is disposed through a cap rock layer 810 into an oil reservoir 812 and water aquifer 814. The oil reservoir 812 is the hydrocarbon formation 804 in this example. Water coning 816 associated with the water aquifer 814 may be experienced.

As with systems of the preceding figures, the system 800 and vertical wellbore 808 may include casing 818 surrounded by cement 820 in the annulus between the casing 818 and the formation 804. The wellbore 808 may include packers 822. The system 800 may include a water separation apparatus 809 as a water separator having an outer wall that defines a tubular cavity for separation. The outer wall of the separator 809 may include a collection of apertures 824 such as tangential slots, oval orifices, a slotted cyclone screen, and so on. A hanger support 826 or other supports may position and retain the apparatus 809 in place.

Tubing 828 such as an extraction conduit may run to the Earth surface. The tubing 828 may transport separated oil to the Earth surface. In some examples, the inlet end of the tubing 828 extends into the tubular cavity of the separator 809 for separation of the oil and gas from the water.

A water inflow tube 830 may provide pump water 845 to the propeller 836 to drive the propeller 836. The water 845 may be characterized as injection water, and the pumping of the water to and through the propeller 836 may be characterized as injecting the water 845 into the propeller 836. The system 800 may include a one-way flip valve 832 for separated water discharging toward a lower chamber 834 in which water accumulates in operation. Also included are the hydraulic propeller 836, a centralizer 838 for the water inflow tube 830 and propeller 836, and a water circulation outlet from the propeller 836 into an outflow tube 842 for water and sludge. In operation, separated water may flow downward through such as in a volume or region near or adjacent the inner surface of the outer wall or tubular cavity. Further, as mentioned, injection water 845 may be pumped in through the water inflow tube 830 to drive the hydraulic propeller 836. As indicated, water 846 (and sludge) may flow out through the outflow tube 842 to the surface.

Figure 9:
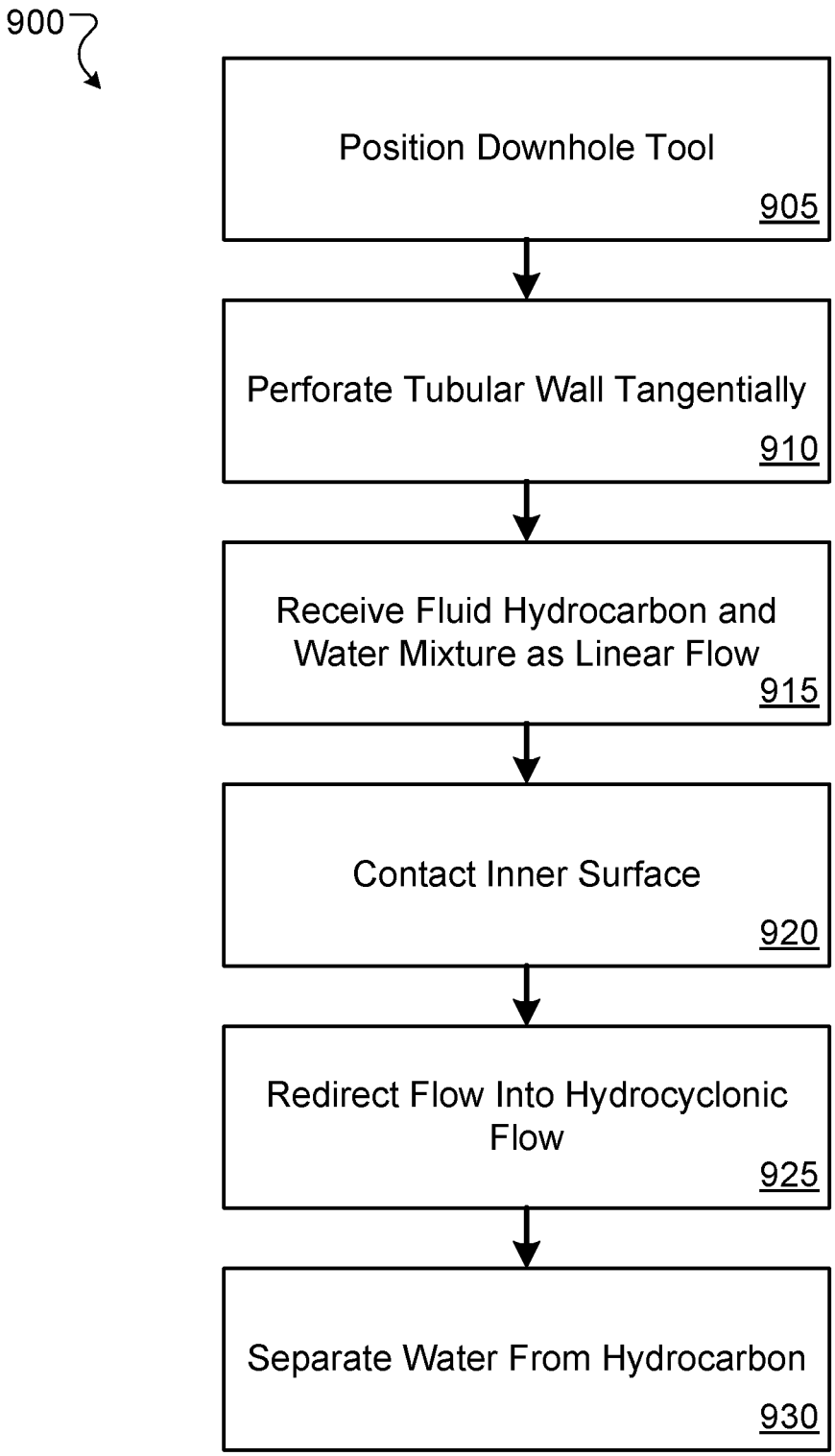
FIG. 9 is a flow diagram of an example process for downhole water separation.

FIG. 9 is a flow diagram of an example process 900 for downhole water separation. In some implementations, the process 900 can be implemented with the example oil well system 100 of FIG. 1.

At 905, a downhole tool is positioned in a wellbore formed in an oil reservoir formation, wherein the wellbore is defined by a tubular wall defining a longitudinal wall axis or central axis, and an inner surface. For example, the tangential perforations 11 can be formed by a perforation tool that is positioned downhole within the example wellbore 4.

At 910 the tubular wall is perforated to define a first channel extending radially though the tubular wall and the inner surface, the first channel defining a first longitudinal channel axis that is parallel or substantially parallel to a first tangent line that passes through a first point on the inner surface. For example, the perforation tool can be activated to perforate the casing 6, the cement 7, and part of the formation 2 to form the tangential perforations 11 that define channels that extend tangentially though the casing 7, the inner surface 102, and partly into the hydrocarbon formation 4.

At 915, a fluid mixture that comprises liquid water and liquid hydrocarbon is received within the wellbore. The fluid mixture moves in a generally linear flow along the first longitudinal channel axis from the oil reservoir formation to the wellbore. For example, pressures within the hydrocarbon formation 4 can urge emulsions of oil and water into the example tangential perforations 302 of FIG. 3 and cause a lateral fluid flow along the longitudinal channel axis 316 toward the tubular cavity 308.

At 920, the inner surface is contacted with the fluid mixture. For example, fluids can enter the tubular cavity 308 to contact the inner surface 312.

At 925, the inner surface redirects the flow away from the first longitudinal channel axis and into a cyclonic or hydrocyclonic flow about the inner surface. For example, the curvature of the inner surface 312 can redirect the linear flow into a rotational (for example, orbital, hydrocyclonic) flow about the central axis 310.

At 930, the liquid water is separated from the liquid hydrocarbon by the hydrocyclonic flow. For instance, the example hydrocyclone 400 of FIG. 4 can create a rotational (for example, orbital, hydrocyclonic) flow that provides a centripetal acceleration to the emulsion of oil and water that can cause the fluid mixture to separate.

The hydrocyclonic flow to separate the liquid water from the liquid hydrocarbon can include flowing the fluid mixture in a rotational flow to impart acceleration upon the fluid mixture to urge the water radially away from the longitudinal wall axis or central axis of the separator and toward the inner surface. The acceleration and relative buoyancy can urge the liquid hydrocarbon radially away from the inner surface and toward the central axis. For example, the centripetal acceleration caused by the vortex flow pattern 416 can urge the emulsion to separate. The denser fluid(s) migrate radially away from the central axis 406. The less dense fluid(s) migrate radially inward toward the central axis 406. With the hydrocyclone 400 oriented such that the central axis 406 is vertical relative to gravity, the separated denser fluid(s) will sink toward an underflow outlet 418 at a lower end 420 of the hydrocyclone 400 under the force of gravity. The separated lighter fluid(s) will rise toward an overflow outlet 426 located proximal the central axis 406 at an upper end 422 of the hydrocyclone 400.

In some implementations, the method can also include drawing the separated liquid hydrocarbon into a tube disposed within and extending into an upper portion of the tubular cavity formed by the tubular wall. The method may include transporting or pumping the separated liquid hydrocarbon through the tube to a surface end of the wellbore. In one example, the separated liquid hydrocarbon is conveyed or pumped via reservoir pressure as a motive force through a tubing 8 to an outlet 20 at the surface. Indeed, the separated oil may be pumped out of the wellbore 4, via reservoir pressure or a pump, or both, through the tubing 8 to an outlet 20 at the surface.

Figure 10:
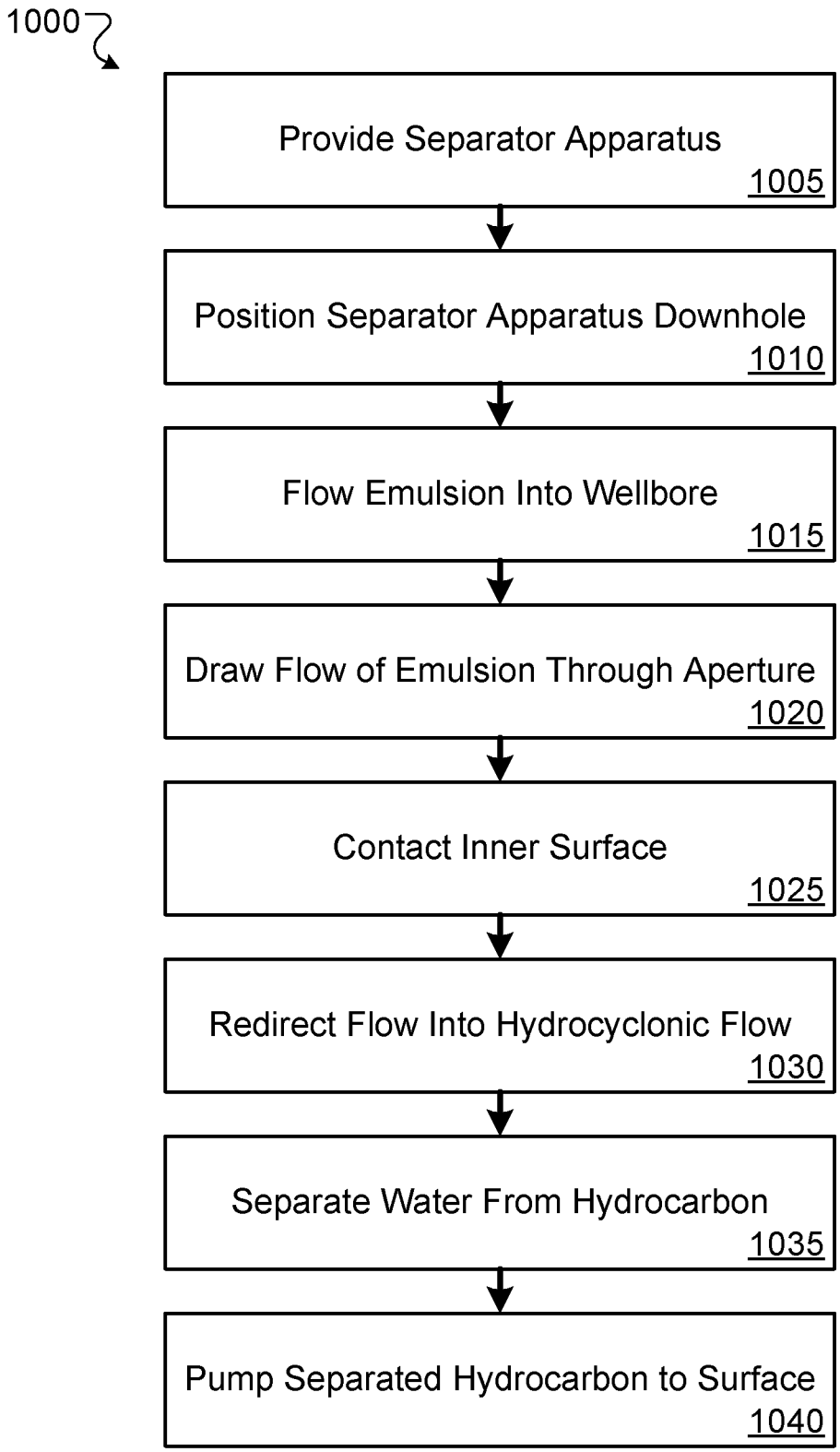
FIG. 10 is a flow diagram of another example process for downhole water separation.

FIG. 10 is a flow diagram of another example process 1000 for downhole water separation. In some implementations, the process 1000 can be used with the downhole water separator apparatus 500, 602, or 809 of FIG. 5A-5B, 6, or 8.

At 1005, a separator apparatus is provided. The separator apparatus includes a tubular housing extending from a first longitudinal housing end to a second longitudinal housing end along a longitudinal wall axis or central axis and defining an inner surface of a tubular cavity. The housing ends may be enclosed other than for inlet or outlet openings or valves if employed, and the like. Valves installed at one or more of the housing ends may provide that the housing end is enclosed.

An extractor tube arranged within the tubular housing extends through the first longitudinal housing end, from a first open end of the extractor tube proximal the first longitudinal housing end to a second open end of the extractor tube within the tubular cavity. At least one aperture is defined radially though the tubular housing and the inner surface and defined longitudinally at a location between the first longitudinal housing end and the second open end. The at least one aperture is formed to create a hydrocyclonic flow about the tubular cavity when a liquid flows into the tubular cavity through the aperture. For example, the downhole water separator apparatus 500 can be provided. In examples, the aperture is multiple apertures that may cooperate to generate or promote tangential entry and cyclonic flow of an entering fluid or emulsion in operation.

In some embodiments, the aperture can be formed as a helical slot through the tubular housing and the inner surface. For example, the apertures 540 are formed as helical ports in the tubular housing 510. In some embodiments, the aperture can be formed as a tangential slot extending radially though the tubular housing and the inner surface, and defining a longitudinal channel axis that is parallel or substantially parallel to a tangent line that passes through a point on the inner surface. For example, the apertures 540 can be formed as tangential slots extending radially though the tubular housing 510 and the inner surface 522. Each of the tangential slots defines a respective longitudinal channel axis that is parallel or substantially parallel to a tangent line that passes through a point on the inner surface 522.

At 1010, the separator apparatus is positioned downhole below a surface of the Earth in a wellbore formed in a geological formation having an emulsion of liquid water and liquid hydrocarbon. For example, the apparatus 500 can be positioned within the wellbore 4 formed in the formation 2.

At 1015, the emulsion is flowed from the geological formation into the wellbore. For example, a mix of oil and water can flow into the wellbore 4 through the example perforations 602.

At 1020, a flow of the emulsion is drawn through the aperture. For example, the extraction of fluid from the tubular cavity 524 can cause additional liquid to be drawn in though the apertures 540 in a flow.

At 1025, the inner surface is contacted with the emulsion. At 1030, the inner surface redirects the flow into a hydrocyclonic flow about the inner surface. For example, the flow can be directed into a hydrocyclonic flow by the curvature of the inner surface 522.

At 1035, the hydrocyclonic flow separates the liquid water from the liquid hydrocarbon. For example, as the emulsified oil and water flows about the axis 520 in a hydrocyclonic vortex, centripetal acceleration caused by the rotational flow causes the oil to migrate toward the axis 520 while urging the water to migrate away from the axis 520.

At 1040, the separated liquid hydrocarbon is pumped though the extractor tube to the surface. For example, the open end 532 can be located proximal the axis (for example, where the separated oil flows in operation). The open end 532 can be hydraulically connected to a pump configured to draw separated oil or other liquid hydrocarbons into the open end 534 and through the extractor tube 530, for example, up to the surface.

In some implementations, pumping the separated liquid hydrocarbon though the extractor tube to the surface can include drawing the liquid hydrocarbon into the second open end and through the extractor tube. For example, the open end 532 can be hydraulically connected to a pump configured to draw oil or other liquid hydrocarbons into the open end 534 and through the extractor tube 530, for example, up to the surface.

In some implementations, the process 1000 can also include reducing pressure within the separator apparatus by the pumping and enclosing the second longitudinal housing end by a valve configured to enclose the second longitudinal housing end when fluid pressure within the tubular cavity is less than fluid pressure outside the tubular housing. The process can include collecting the liquid water proximal the second longitudinal housing end, equalizing pressure within the separator apparatus by halting the pumping, opening the second longitudinal housing end when fluid pressure within the tubular cavity is equal to or greater than fluid pressure outside the tubular housing, and flowing the collected liquid water out the second longitudinal housing end through the valve. For example, the flapper valve 550 is configured to enclose the longitudinal housing end 514 when fluid pressure within the tubular cavity 524 is less than fluid pressure outside the tubular housing 510 (for example, the valve is drawn shut by suction). The flapper valve 550 is configured to open the longitudinal housing end 514 when fluid pressure within the tubular cavity 524 is equal to or greater than fluid pressure outside the tubular housing 510. In use, the separated water (and solids) can collect in the lower end of the apparatus 500 near the flapper valve 550 while the pump is active (for example, as shown in FIG. 5A). When the pump is shut off the flapper valve can open and allow the separated water and solids to flow out (for example, sink downhole).

An embodiment includes a water separation apparatus having a tubular housing extending from an enclosed or partially-enclosed first longitudinal housing end to an enclosed or partially-enclosed second longitudinal housing end along a central axis and defining an inner surface of a tubular cavity. An extractor tube is arranged within the tubular housing and extending through the first longitudinal housing end, from a first open end proximal the first longitudinal housing end to a second open end within the tubular cavity; at least one aperture defined though the tubular housing and the inner surface; and a propeller configured to be driven to urge a hydrocyclonic flow within the tubular cavity.

Another embodiment is a method for downhole water separation including: providing a separator apparatus comprising: a tubular housing extending from an enclosed first longitudinal housing end to an enclosed second longitudinal housing end along a longitudinal central and defining an inner surface of a tubular cavity; an extractor tube arranged within the tubular housing and extending through the first longitudinal housing end, from a first open end proximal the first longitudinal housing end to a second open end within the tubular cavity; at least one aperture defined radially though the tubular housing and the inner surface; and a propeller within the tubular cavity. The method may include positioning the separator apparatus downhole, below a surface of the Earth, in a wellbore formed in a geological formation having an emulsion of liquid water and liquid hydrocarbon; flowing the emulsion from the geological formation through the aperture and into the tubular cavity; driving the propeller to urge a hydrocyclonic flow of the emulsion within the tubular cavity; separating, by the hydrocyclonic flow, the liquid water from the liquid hydrocarbon; and pumping the separated liquid hydrocarbon though the extractor tube to the surface.

Although a few implementations have been described in detail above, other modifications are possible. For example, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other implementations are within the scope of the following claims.

What is claimed is:

1. A method comprising:

positioning a water separation apparatus within a wellbore formed in an oil reservoir formation, wherein the water separation apparatus comprises:

a tubular housing extending from an enclosed first longitudinal housing end to an enclosed second longitudinal housing end along a central axis and defining a housing inner surface of a tubular cavity;

an extractor tube arranged within the tubular housing and extending through the first longitudinal housing end, from a first open end proximal the first longitudinal housing end to a second open end within the tubular cavity; and at least one aperture defined radially though the tubular housing and the housing inner surface, defined longitudinally at a location between the first longitudinal housing end and the second open end, and formed to create a hydrocyclonic flow about the tubular cavity when a liquid flows into the tubular cavity through the aperture;

receiving within the water separation apparatus and through a first channel defined by the at least one aperture, the first channel defining a first longitudinal channel axis parallel to a first tangent line tangential to the tubular, a fluid mixture that comprises liquid water and liquid hydrocarbon moving in a linear flow along the first longitudinal channel axis from the oil reservoir formation to the wellbore and into the tubular cavity;

contacting the housing inner surface with the fluid mixture;

redirecting, by the housing inner surface, the flow away from the central axis and into the hydrocyclonic flow about the housing inner surface;

separating, by the hydrocyclonic flow, the liquid water from the liquid hydrocarbon;

drawing the separated liquid hydrocarbon into the extractor tube conveying the separated liquid hydrocarbon through the second open end of the extractor tube toward the first open end of the extractor tube and further to a surface end of the wellbore;

conveying the separated liquid water through the enclosed second longitudinal housing end of the tubular housing in a downhole direction;

flowing the separated liquid water through a one-way valve at a packer in the wellbore to a chamber at a lower portion of the wellbore;

disposing a hydraulic propeller in the chamber;

agitating, via a hydraulic propeller disposed in the chamber, the separated liquid water in the chamber to cause debris in the chamber to become suspended in the separated liquid water; and pumping a suspension of the separated liquid water and the debris uphole toward the surface end of the wellbore from the chamber.

2. The method of claim 1, wherein separating, by the hydrocyclonic flow, the liquid water from the liquid hydrocarbon comprises:

flowing the fluid mixture in a rotational flow, wherein the liquid hydrocarbon has a buoyancy that is greater than that of the liquid water;

imparting, by the rotation flow, an acceleration upon the fluid mixture;

urging, by the acceleration, the liquid water radially away from the central axis and toward the inner surface; and urging, by the buoyancy and the acceleration, the liquid hydrocarbon radially away from the inner surface and toward the central axis.

3. The method of claim 1, wherein the first channel defines a first longitudinal channel axis parallel to the first tangent line tangential to the tubular housing that passes through a first point on an inner surface of the wellbore formed in the oil reservoir formation and extends radially through a tubular wall and the inner surface of the wellbore, wherein the wellbore inner surface and the packer at least partially define the chamber, wherein the tubular wall further defines a first radius extending radially from a central axis defined by the tubular wall to the first point, and the first longitudinal channel axis and the first radius form a first angle that is within a first range of about 45° to about 135° or a second range of about 225° to about 315°.

4. The method of claim 3, wherein the wellbore further comprises a second channel extending radially though the tubular wall and the inner surface, and defining a second longitudinal channel axis parallel to a second tangent line that passes through a second point spaced apart from the first point on the inner surface, wherein the tubular wall further defines a second radius extending radially from the central axis to the second point, and the second longitudinal channel axis and the second radius form a second angle that is within same one of the first range or the second range as the first angle.

5. The method of claim 3, further comprising applying back pressure to the chamber to maintain the one-way valve in the packer in a closed state.

6. The method of claim 1, comprising collecting the separated liquid water in a chamber at a lower portion of the wellbore and pumping the separated liquid water from the chamber through tubing in the wellbore to a surface end of the wellbore, wherein the tubular wall comprises a casing and a cement layer arranged radially about the casing in contact with the oil reservoir formation, wherein the first channel extends through the casing and the cement layer.

7. The method of claim 1, comprising pumping the separated liquid water to a water treatment unit to remove solids from the separated liquid water, wherein the first channel extends into and is partly defined by a perforation formed in the oil reservoir formation along the first longitudinal channel axis.

8. The method of claim 1, wherein receiving within the water separation apparatus, the first fluid mixture comprises drawing a flow of the fluid mixture through the at least one aperture.

9. The method of claim 1, further comprising:

coupling a pump to the first open end of the extractor tube; and pumping the separated liquid hydrocarbon through the first open end of the extractor tube to the surface.

10. The method of claim 1, wherein agitating, via the hydraulic propeller, the separated liquid water comprises hydraulically operating the liquid propeller, wherein hydraulically operating the liquid propeller comprises:

disposing a water inlet tube from the surface end of the wellbore to the chamber;

coupling the liquid propeller to an end of the water inlet tube within the chamber; and pumping water from the surface end of the wellbore through the water inlet tube to the liquid propeller.

11. A method comprising:

flowing a fluid mixture that comprises liquid water and liquid hydrocarbon into a water separation apparatus positioned within a wellbore formed in an oil reservoir formation, the water separation apparatus causing hydrocyclonic flow of the fluid mixture, the hydrocyclonic flow causing the liquid water to separate from the liquid hydrocarbon;

conveying the separated liquid hydrocarbon through an open end of an extractor tube arranged within a tubular housing of the water separation apparatus and toward a surface end of the wellbore;

conveying the separated liquid water in a downhole direction into a chamber at a lower portion of the wellbore, the chamber separated from a remainder of the wellbore by a packer;

agitating, by a hydraulic propeller disposed in the chamber, the separated liquid water in the chamber to cause debris in the chamber to become suspended in the separated liquid water; and pumping a suspension of the separated liquid water and the debris uphole toward the surface end of the wellbore from the chamber.

12. The method of claim 11, wherein agitating, by the hydraulic propeller, the separated liquid water comprises hydraulically operating the liquid propeller, wherein hydraulically operating, the liquid propeller comprises:

disposing a water net tube from the surface end of the we to the chamber;

coupling the liquid propeller to an end of the water net tube within the chamber; and pumping water from the surface end of the wellbore through the water inlet tube to the liquid propeller.

13. The method of claim 11, further comprising applying back pressure to the chamber to maintain a one-way valve in the packer in a closed state.

* * * * *